US010612859B2

(12) United States Patent
Numata et al.

(10) Patent No.: US 10,612,859 B2
(45) Date of Patent: Apr. 7, 2020

(54) HEAT EXCHANGER

(71) Applicant: Daikin Applied Americas Inc., Minneapolis, MN (US)

(72) Inventors: Mitsuharu Numata, Plymouth, MN (US); Kazushige Kasai, Osaka (JP)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 0 days.

(21) Appl. No.: 15/838,835

(22) Filed: Dec. 12, 2017

(65) Prior Publication Data

US 2018/0112924 A1 Apr. 26, 2018

Related U.S. Application Data

(63) Continuation of application No. 13/453,503, filed on Apr. 23, 2012, now abandoned.

(51) Int. Cl.

| | |
|---|---|
| ***F28F 25/04*** | (2006.01) |
| ***F28D 5/02*** | (2006.01) |
| ***F28F 25/02*** | (2006.01) |
| ***F28F 25/08*** | (2006.01) |
| ***F28D 7/16*** | (2006.01) |
| *F25B 39/02* | (2006.01) |

(52) U.S. Cl.

CPC ..... *F28D 5/02* (2013.01); *F28D 7/1607* (2013.01); *F28F 25/02* (2013.01); *F28F 25/04* (2013.01); *F28F 25/08* (2013.01); *F25B 39/028* (2013.01)

(58) Field of Classification Search

CPC ..... F28D 5/02; F28F 25/04; F25B 39/028

USPC ..... 165/111–117

See application file for complete search history.

(56) References Cited

U.S. PATENT DOCUMENTS

| | | | | |
|---|---|---|---|---|
| 320,144 | A * | 6/1885 | Kux | F25B 43/046 62/475 |
| 939,143 | A * | 11/1909 | Lillie | F28D 3/02 165/117 |
| 2,038,002 | A | 4/1936 | Ris | |
| 2,485,844 | A | 10/1949 | Reid, Jr. | |
| 2,729,952 | A | 1/1956 | Whitlow | |

(Continued)

FOREIGN PATENT DOCUMENTS

| | | | |
|---|---|---|---|
| JP | 43-10680 | U | 5/1968 |
| JP | 5-59165 | U | 8/1993 |

(Continued)

*Primary Examiner* — Leonard R Leo

(74) *Attorney, Agent, or Firm* — Global IP Counselors, LLP

(57) ABSTRACT

A heat exchanger is adapted to be used in a vapor compression system. The tube bundle includes a plurality of heat transfer tubes in a falling film region and in an accumulating region. The heat transfer tubes in the falling film region are arranged in a plurality of columns extending parallel to each other. The heat transfer tubes in the accumulating region are arranged in a plurality of rows extending parallel to each other. A trough part includes a plurality of trough sections disposed respectively below the rows of the heat transfer tubes in the accumulating region to accumulate the refrigerant therein. A ratio between a number of rows of the heat transfer tubes in the accumulating region and a number of the heat transfer tubes in each of the columns in the falling film region is about 1:9 to about 2:8.

12 Claims, 24 Drawing Sheets

(56) References Cited

U.S. PATENT DOCUMENTS

| | | | | |
|---|---|---|---|---|
| 3,048,373 | A * | 8/1962 | Bauer et al. | B01D 3/32 165/111 |
| 3,538,983 | A | 11/1970 | Thomae et al. | |
| 4,223,539 | A | 9/1980 | Webb et al. | |
| 5,561,987 | A | 10/1996 | Hartfield et al. | |
| 5,638,691 | A | 6/1997 | Hartfield et al. | |
| 5,839,294 | A | 11/1998 | Chiang et al. | |
| 6,170,286 | B1 | 1/2001 | Keuper | |
| 6,233,967 | B1 | 5/2001 | Seewald et al. | |
| 6,253,571 | B1 * | 7/2001 | Fujii | F25B 15/008 62/484 |
| 6,293,112 | B1 | 9/2001 | Moeykens et al. | |
| 6,341,492 | B1 | 1/2002 | Carey | |
| 6,516,627 | B2 | 2/2003 | Ring et al. | |
| 7,849,710 | B2 | 12/2010 | De Larminat et al. | |
| 2008/0148767 | A1 | 6/2008 | De Larminat et al. | |
| 2008/0149311 | A1 | 6/2008 | Liu et al. | |
| 2009/0178790 | A1 | 7/2009 | Schreiber et al. | |

FOREIGN PATENT DOCUMENTS

| | | | |
|---|---|---|---|
| JP | 10-306959 | A | 11/1998 |
| JP | 2000-230760 | A | 8/2000 |
| JP | 2003-517560 | A | 5/2003 |
| JP | 2011-80756 | A | 4/2011 |

* cited by examiner

HEAT EXCHANGER

CROSS-REFERENCE TO RELATED APPLICATIONS

This application is a divisional application of U.S. patent application Ser. No. 13/453,503, filed on Apr. 23, 2012. The entire disclosure of U.S. patent application Ser. No. 13/453,503 is hereby incorporated herein by reference.

BACKGROUND OF THE INVENTION

Field of the Invention

This invention generally relates to a heat exchanger adapted to be used in a vapor compression system. More specifically, this invention relates to a heat exchanger including a trough part extending under at least one of the heat transfer tubes to accumulate the refrigerant therein.

Background Information

Vapor compression refrigeration has been the most commonly used method for air-conditioning of large buildings or the like. Conventional vapor compression refrigeration systems are typically provided with an evaporator, which is a heat exchanger that allows the refrigerant to evaporate from liquid to vapor while absorbing heat from liquid to be cooled passing through the evaporator. One type of evaporator includes a tube bundle having a plurality of horizontally extending heat transfer tubes through which the liquid to be cooled is circulated, and the tube bundle is housed inside a cylindrical shell. There are several known methods for evaporating the refrigerant in this type of evaporator. In a flooded evaporator, the shell is filled with liquid refrigerant and the heat transfer tubes are immersed in a pool of the liquid refrigerant so that the liquid refrigerant boils and/or evaporates as vapor. In a falling film evaporator, liquid refrigerant is deposited onto exterior surfaces of the heat transfer tubes from above so that a layer or a thin film of the liquid refrigerant is formed along the exterior surfaces of the heat transfer tubes. Heat from walls of the heat transfer tubes is transferred via convection and/or conduction through the liquid film to the vapor-liquid interface where part of the liquid refrigerant evaporates, and thus, heat is removed from the water flowing inside of the heat transfer tubes. The liquid refrigerant that does not evaporate falls vertically from the heat transfer tube at an upper position toward the heat transfer tube at a lower position by force of gravity. There is also a hybrid falling film evaporator, in which the liquid refrigerant is deposited on the exterior surfaces of some of the heat transfer tubes in the tube bundle and the other heat transfer tubes in the tube bundle are immersed in the liquid refrigerant that has been collected at the bottom portion of the shell.

Although the flooded evaporators exhibit high heat transfer performance, the flooded evaporators require a considerable amount of refrigerant because the heat transfer tubes are immersed in a pool of the liquid refrigerant. With recent development of new and high-cost refrigerant having a much lower global warming potential (such as R1234ze or R1234yf), it is desirable to reduce the refrigerant charge in the evaporator. The main advantage of the falling film evaporators is that the refrigerant charge can be reduced while ensuring good heat transfer performance. Therefore, the falling film evaporators have a significant potential to replace the flooded evaporators in large refrigeration systems.

U.S. Pat. No. 5,839,294 discloses a hybrid falling film evaporator that has a section that operates in a flooded mode and a section that operates in a falling film mode. More specifically, the evaporator disclosed in this publication includes an outer shell through which passes a plurality of horizontal heat transfer tubes in a tube bundle. A distribution system is provided in overlying relationship with the upper most level of the heat transfer tubes in the tube bundle so that refrigerant which enters into the shell is dispensed onto the top of the tubes. The liquid refrigerant forms a film along an exterior wall of each of the heat transfer tubes where part of the liquid refrigerant evaporates as the vapor refrigerant. The rest of the liquid refrigerant collects in the lower portion of the shell. In steady state operation, the level of liquid refrigerant within the outer shell is maintained at a level such that at least twenty-five percent of the horizontal heat transfer tubes near the lower end of the shell are immersed in liquid refrigerant. Therefore, in this publication, the evaporator operates with the heat transfer tubes in the lower section of the shell operating in a flooded heat transfer mode, while the heat transfer tubes which are not immersed in liquid refrigerant operate in a falling film heat transfer mode.

U.S. Pat. No. 7,849,710 discloses a falling film evaporator in which liquid refrigerant collected in a lower portion of an evaporator shell is recirculated. More specifically, the evaporator disclosed in this publication includes the shell having a tube bundle with a plurality of heat transfer tubes extending substantially horizontally in the shell. Liquid refrigerant that enters in the shell is directed from a distributor to the heat transfer tubes. The liquid refrigerant creates a film along an exterior wall of each of the heat transfer tubes where part of the liquid refrigerant evaporates as the vapor refrigerant. The rest of the liquid refrigerant collects in a lower portion of the shell. In this publication, a pump or an ejector is provided to draw the liquid refrigerant collected in the lower portion of the shell to recirculate the liquid refrigerant from the lower portion of the shell to the distributor.

SUMMARY OF THE INVENTION

The hybrid falling film evaporator disclosed in U.S. Pat. No. 5,839,294 as mentioned above still presents a problem that it requires a relatively large amount of refrigerant charge because of the existence of the flooded section at the bottom portion of the shell. On the other hand, with the evaporator disclosed in U.S. Pat. No. 7,849,710, which recirculates the collected liquid refrigerant from the bottom portion of the shell to the distributor, an excess amount of circulated refrigerant is required in order to rewet dry patches on the heat transfer tubes in case such dry patches are formed due to fluctuation in performance of the evaporator. Moreover, when a compressor in the vapor compression system utilizes lubrication oil (refrigerant oil), the oil migrated from the compressor into the refrigeration circuit of the vapor compression system tends to accumulate in the evaporator because the oil is less volatile than the refrigerant. Thus, with the refrigerant recirculation system as disclosed in U.S. Pat. No. 7,849,710, the oil is recirculated within the evaporator along with the liquid refrigerant, which causes a high concentration of the oil in the liquid refrigerant circulating in the evaporator. Therefore, performance of the evaporator is degraded.

In view of the above, one object of the present invention is to provide a heat exchanger that can reduce the amount of refrigerant charge while ensuring good performance of the heat exchanger.

Another object of the present invention is to provide a heat exchanger that accumulates refrigerant oil migrated from a compressor into a refrigeration circuit of a vapor compression system and discharges the refrigerant oil outside of the evaporator.

A heat exchanger is adapted to be used in a vapor compression system. The heat exchanger includes a shell, a distributing part, a tube bundle and a trough part. The shell has a longitudinal center axis extending generally parallel to a horizontal plane. The distributing part is disposed inside of the shell, and configured and arranged to distribute a refrigerant. The tube bundle includes a plurality of heat transfer tubes disposed inside of the shell below the distributing part so that the refrigerant discharged from the distributor is supplied onto the tube bundle. The heat transfer tubes extend generally parallel to the longitudinal center axis of the shell. The tube bundle include a falling film region and an accumulating region arranged below the falling film region. The heat transfer tubes in the falling film region are arranged in a plurality of columns extending parallel to each other when viewed along the longitudinal center axis of the shell. The heat transfer tubes in the accumulating region are arranged in a plurality of rows extending parallel to each other when viewed along the longitudinal center axis of the shell. A trough part includes a plurality of trough sections extending generally parallel to the longitudinal center axis of the shell and disposed respectively below the rows of the heat transfer tubes in the accumulating region to accumulate the refrigerant therein. The trough part at least partially overlaps with the at least one of the heat transfer tubes when viewed along a horizontal direction perpendicular to the longitudinal center axis of the shell. A ratio between a number of rows of the heat transfer tubes in the accumulating region and a number of the heat transfer tubes in each of the columns in the falling film region is about 1:9 to about 2:8.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
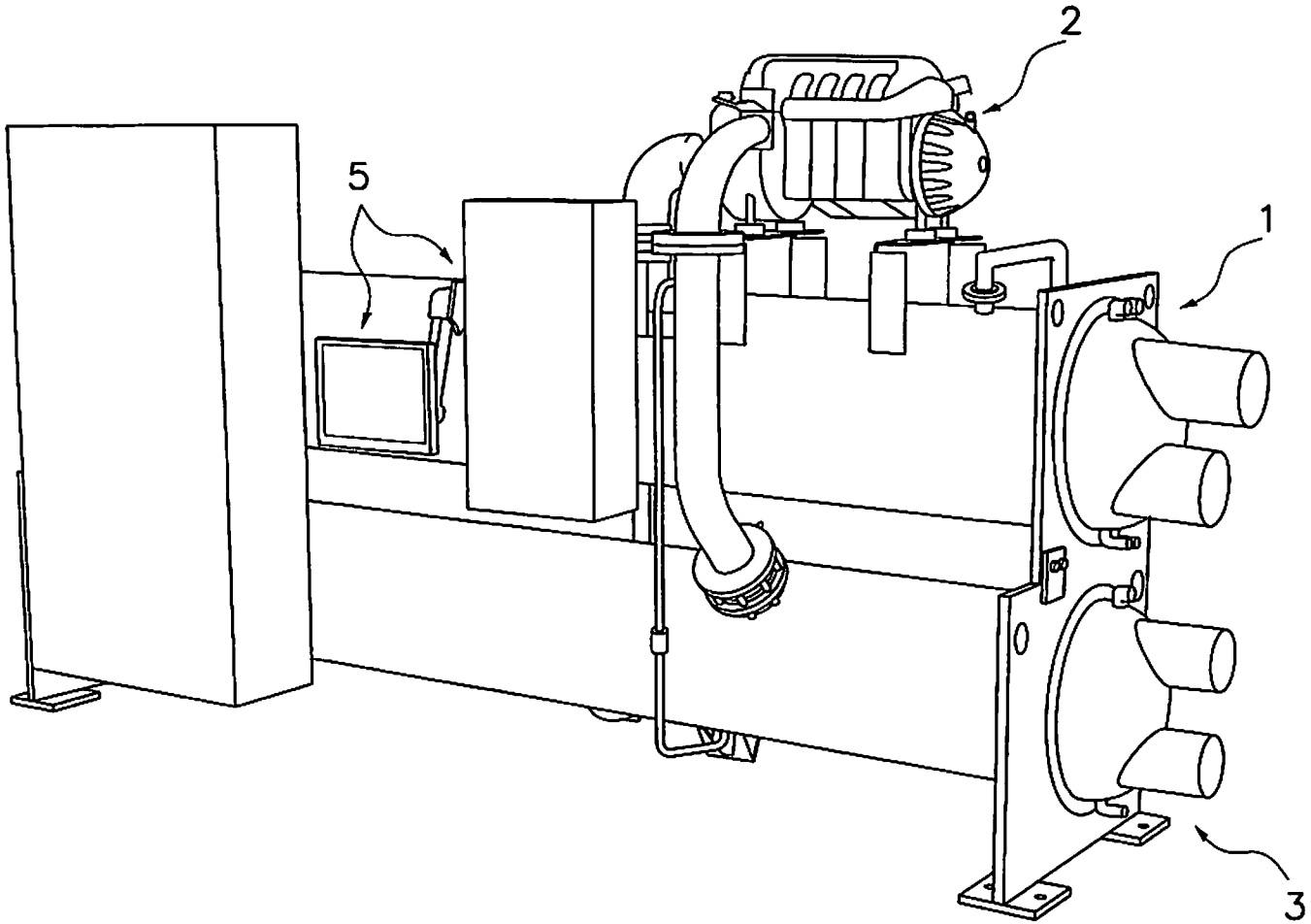
FIG. 1 is a simplified, overall perspective view of a vapor compression system including a heat exchanger according to a first embodiment of the present invention.
Figure 2:
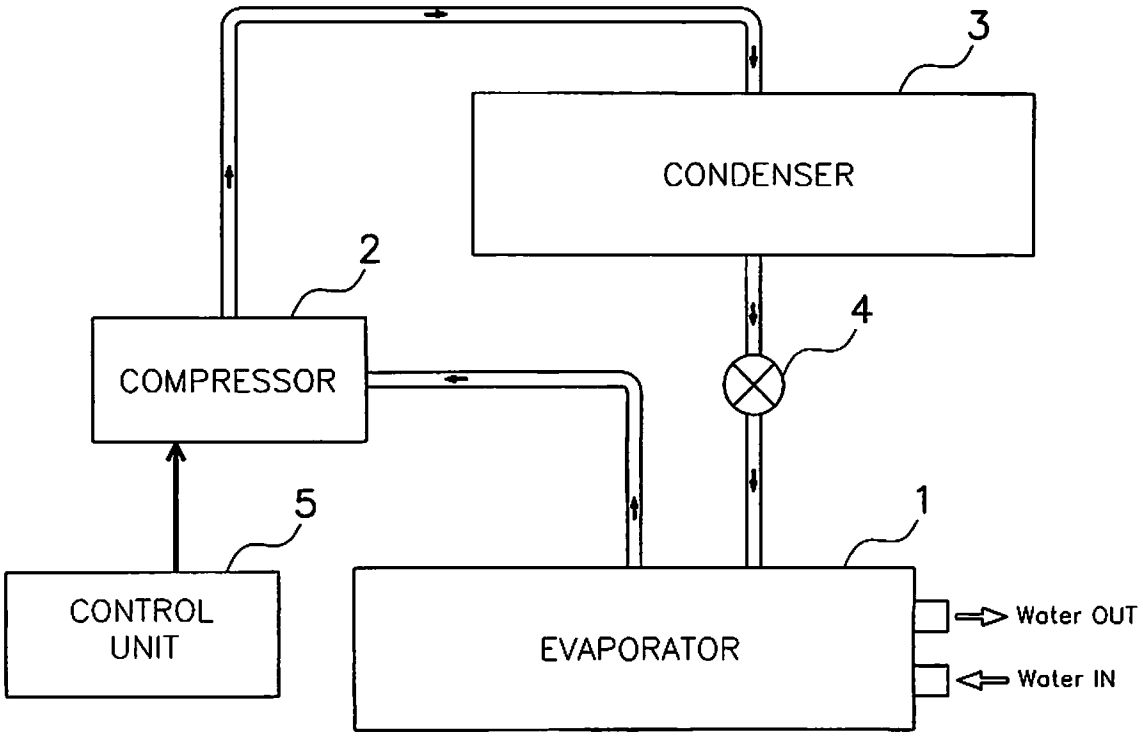
FIG. 2 is a block diagram illustrating a refrigeration circuit of the vapor compression system including the heat exchanger according to the first embodiment of the present invention.

Referring initially to FIGS. 1 and 2, a vapor compression system including a heat exchanger according to a first embodiment will be explained. As seen in FIG. 1, the vapor compression system according to the first embodiment is a chiller that may be used in a heating, ventilation and air conditioning (HVAC) system for air-conditioning of large buildings and the like. The vapor compression system of the first embodiment is configured and arranged to remove heat from liquid to be cooled (e.g., water, ethylene, ethylene glycol, calcium chloride brine, etc.) via a vapor-compression refrigeration cycle.

As shown in FIGS. 1 and 2, the vapor compression system includes the following four main components: an evaporator 1, a compressor 2, a condenser 3 and an expansion device 4.

The evaporator 1 is a heat exchanger that removes heat from the liquid to be cooled (in this example, water) passing through the evaporator 1 to lower the temperature of the water as a circulating refrigerant evaporates in the evaporator 1. The refrigerant entering the evaporator 1 is in a two-phase gas/liquid state. The liquid refrigerant evaporates as the vapor refrigerant in the evaporator 1 while absorbing heat from the water.

The low pressure, low temperature vapor refrigerant is discharged from the evaporator 1 and enters the compressor 2 by suction. In the compressor 2, the vapor refrigerant is compressed to the higher pressure, higher temperature vapor. The compressor 2 may be any type of conventional compressor, for example, centrifugal compressor, scroll compressor, reciprocating compressor, screw compressor, etc.

Next, the high temperature, high pressure vapor refrigerant enters the condenser 3, which is another heat exchanger that removes heat from the vapor refrigerant causing it to condense from a gas state to a liquid state. The condenser 3 may be an air-cooled type, a water-cooled type, or any suitable type of condenser. The heat raises the temperature of cooling water or air passing through the condenser 3, and the heat is rejected to outside of the system as being carried by the cooling water or air.

The condensed liquid refrigerant then enters through the expansion device 4 where the refrigerant undergoes an abrupt reduction in pressure. The expansion device 4 may be as simple as an orifice plate or as complicated as an electronic modulating thermal expansion valve. The abrupt pressure reduction results in partial evaporation of the liquid refrigerant, and thus, the refrigerant entering the evaporator 1 is in a two-phase gas/liquid state.

Some examples of refrigerants used in the vapor compression system are hydrofluorocarbon (HFC) based refrigerants, for example, R-410A, R-407C, and R-134a, hydrofluoro olefin (HFO), unsaturated HFC based refrigerant, for example, R-1234ze, and R-1234yf, natural refrigerants, for example, R-717 and R-718, or any other suitable type of refrigerant.

The vapor compression system includes a control unit 5 that is operatively coupled to a drive mechanism of the compressor 2 to control operation of the vapor compression system.

It will be apparent to those skilled in the art from this disclosure that conventional compressor, condenser and expansion device may be used respectively as the compressor 2, the condenser 3 and the expansion device 4 in order to carry out the present invention. In other words, the compressor 2, the condenser 3 and the expansion device 4 are conventional components that are well known in the art. Since the compressor 2, the condenser 3 and the expansion device 4 are well known in the art, these structures will not be discussed or illustrated in detail herein. The vapor compression system may include a plurality of evaporators 1, compressors 2 and/or condensers 3.

Figure 3:
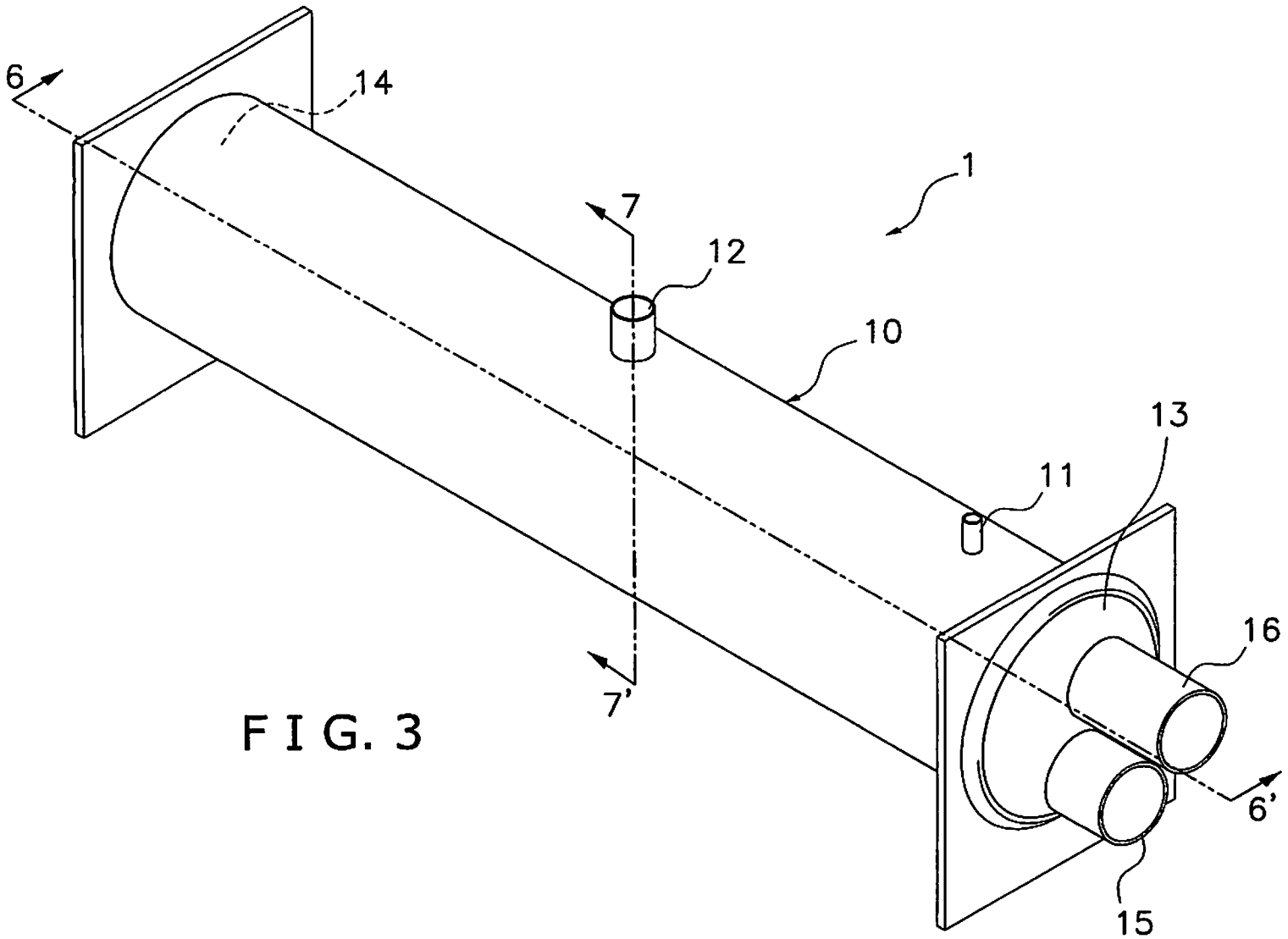
FIG. 3 is a simplified perspective view of the heat exchanger according to the first embodiment of the present invention.
Figure 4:
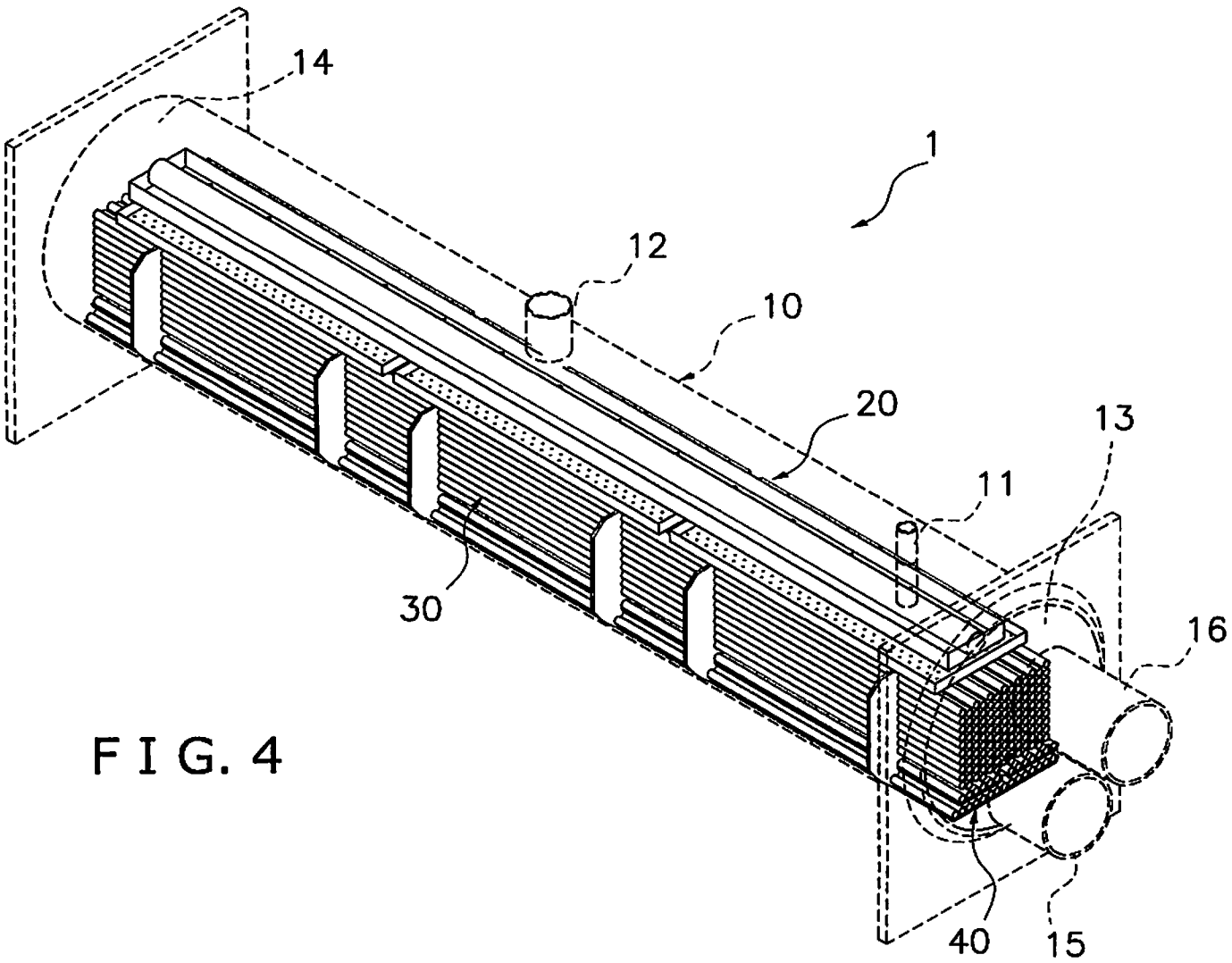
FIG. 4 is a simplified perspective view of an internal structure of the heat exchanger according to the first embodiment of the present invention.
Figure 5:
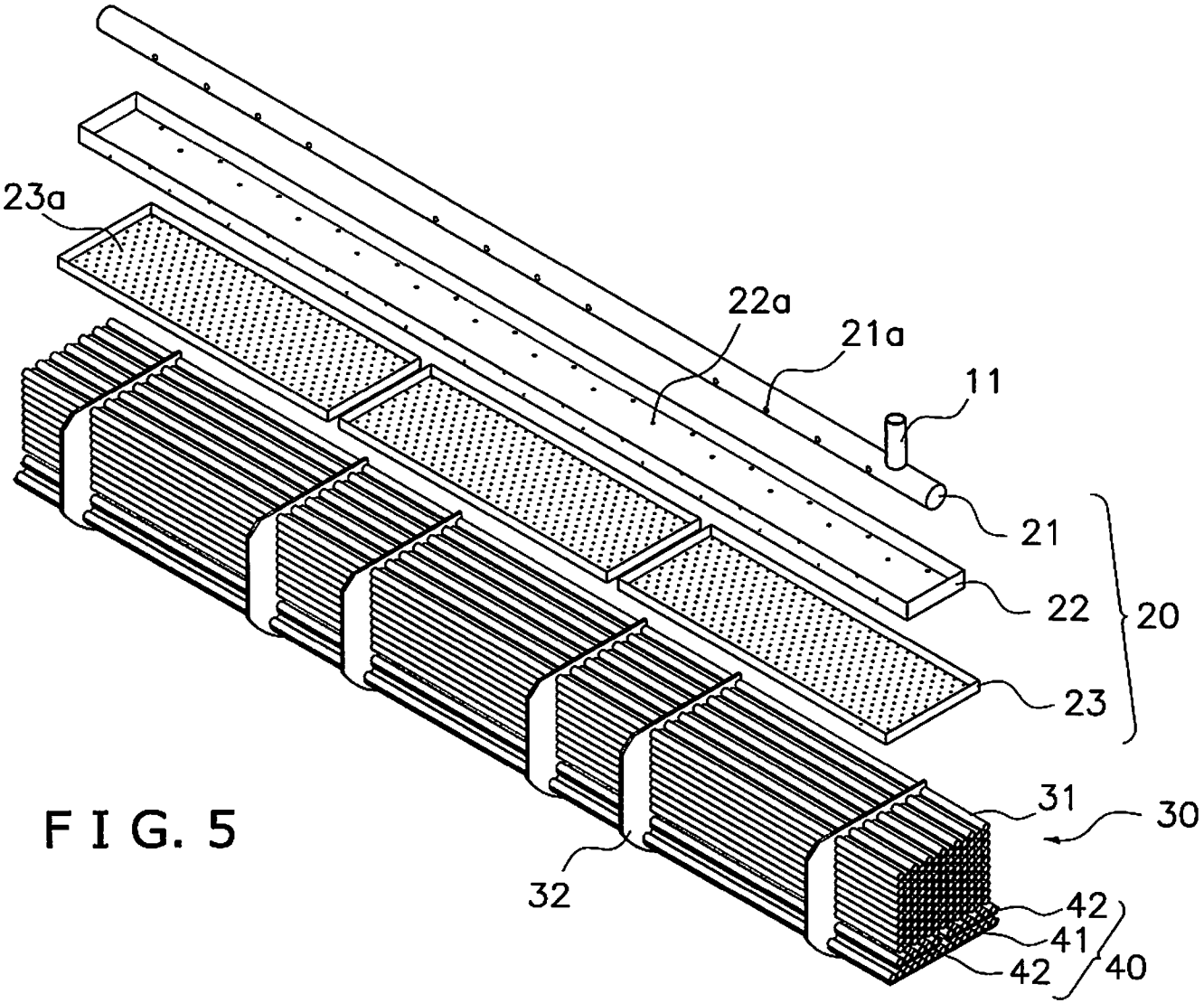
FIG. 5 is an exploded view of the internal structure of the heat exchanger according to the first embodiment of the present invention.
Figure 6:
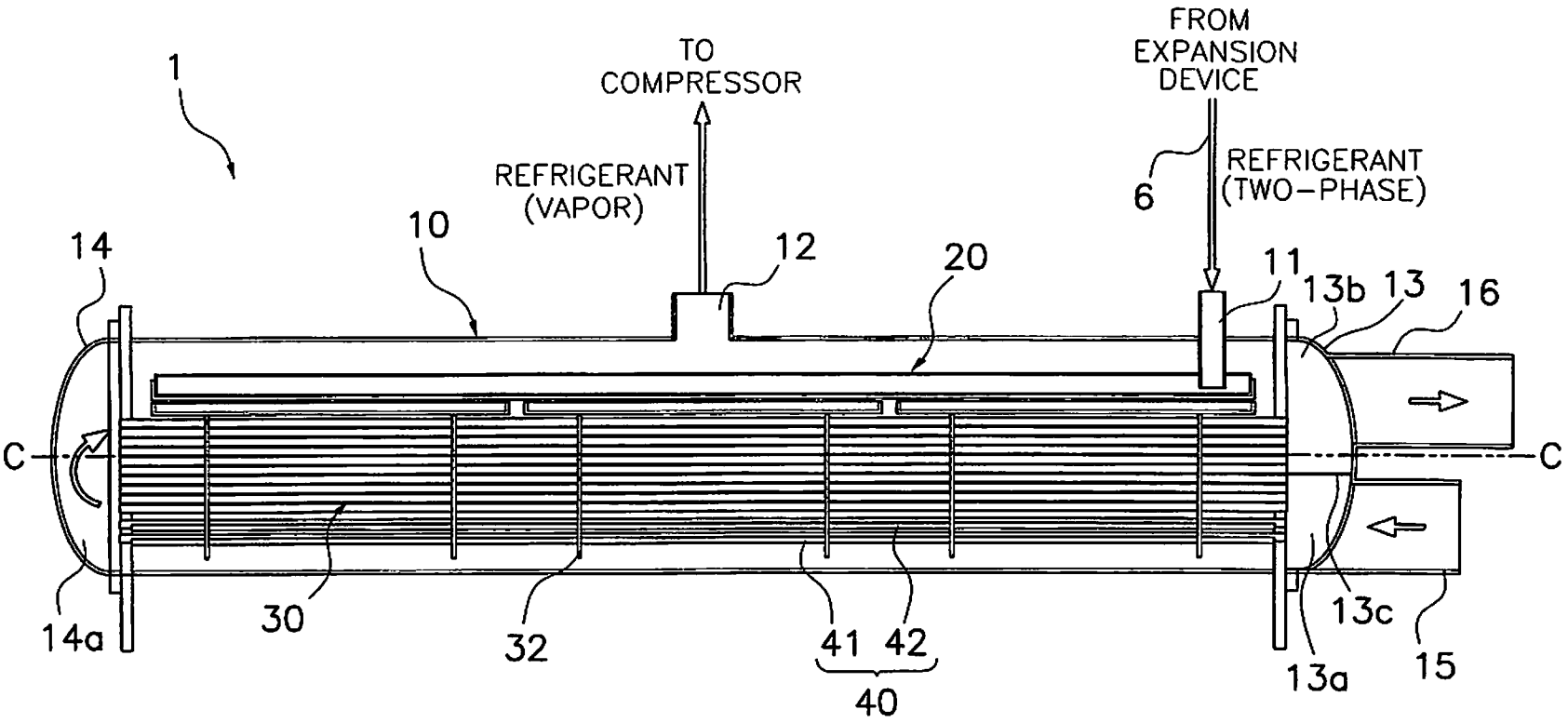
FIG. 6 is a simplified longitudinal cross sectional view of the heat exchanger according to the first embodiment of the present invention as taken along a section line 6-6' in FIG. 3.

Referring now to FIGS. 3 to 5, the detailed structure of the evaporator 1, which is the heat exchanger according to the first embodiment, will be explained. As shown in FIGS. 3 and 6, the evaporator 1 includes a shell 10 having a generally cylindrical shape with a longitudinal center axis C (FIG. 6) extending generally in the horizontal direction. The shell 10 includes a connection head member 13 defining an inlet water chamber 13*a* and an outlet water chamber 13*b*, and a return head member 14 defining a water chamber 14*a*. The connection head member 13 and the return head member 14 are fixedly coupled to longitudinal ends of a cylindrical body of the shell 10. The inlet water chamber 13*a* and the outlet water chamber 13*b* are partitioned by a water baffle 13*c*. The connection head member 13 includes a water inlet pipe 15 through which water enters the shell 10 and a water outlet pipe 16 through which the water is discharged from the shell 10. As shown in FIGS. 3 and 6, the shell 10 further includes a refrigerant inlet pipe 11 and a refrigerant outlet pipe 12. The refrigerant inlet pipe 11 is fluidly connected to the expansion device 4 via a supply conduit 6 (FIG. 7) to introduce the two-phase refrigerant into the shell 10. The expansion device 4 may be directly coupled at the refrigerant inlet pipe 11. The liquid component in the two-phase refrigerant boils and/or evaporates in the evaporator 1 and goes through phase change from liquid to vapor as it absorbs heat from the water passing through the evaporator 1. The vapor refrigerant is drawn from the refrigerant outlet pipe 12 to the compressor 2 by suction.

Figure 7:
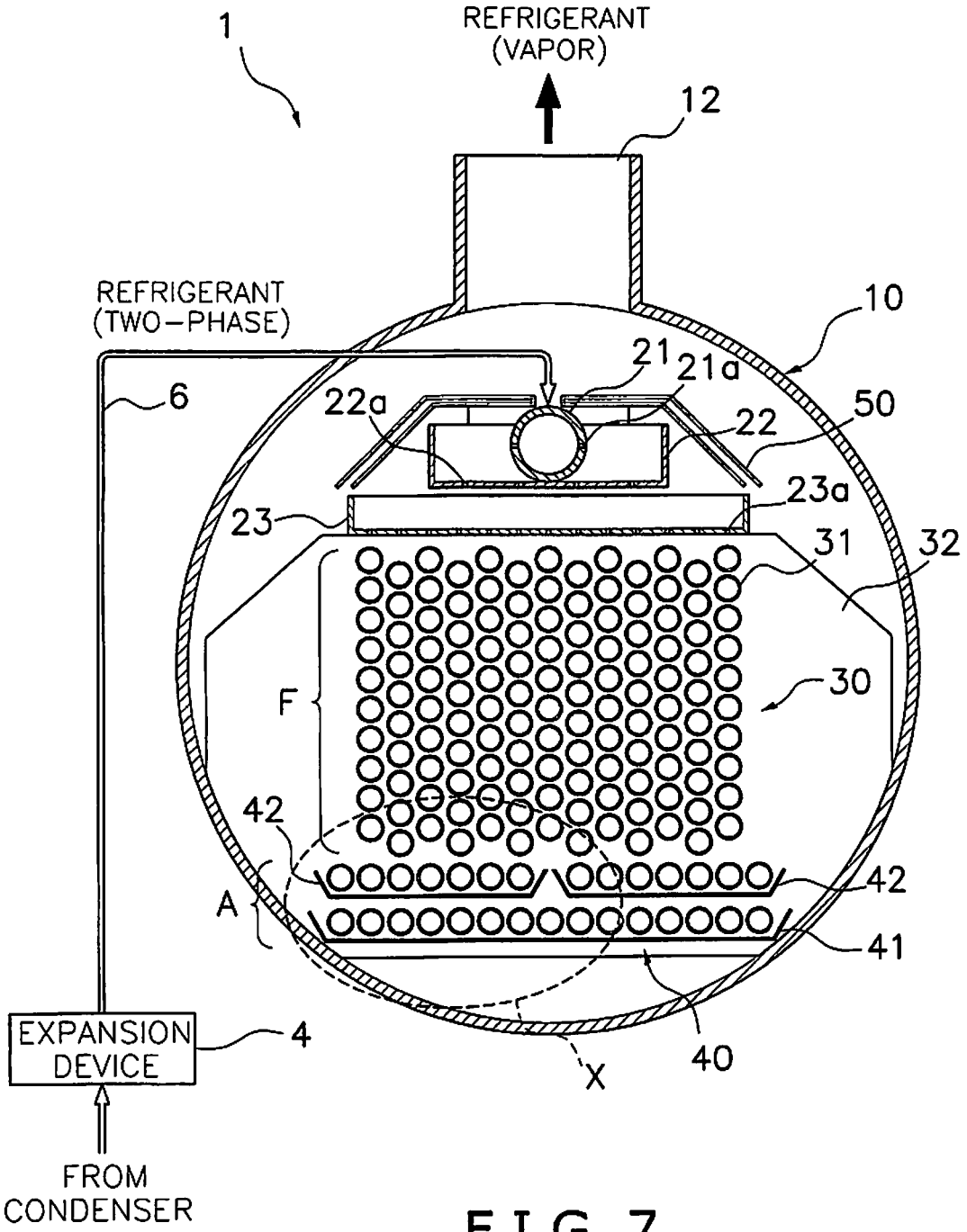
FIG. 7 is a simplified transverse cross sectional view of the heat exchanger according to the first embodiment of the present invention as taken along a section line 7-7' in FIG. 3.

FIG. 4 is a simplified perspective view illustrating an internal structure accommodated in the shell 10. FIG. 5 is an exploded view of the internal structure shown in FIG. 4. As shown in FIGS. 4 and 5, the evaporator 1 basically includes a distributing part 20, a tube bundle 30, and a trough part 40. The evaporator 1 preferably further includes a baffle member 50 as shown in FIG. 7 although illustration of the baffle member 50 is omitted in FIGS. 4-6 for the sake of brevity.

The distributing part 20 is configured and arranged to serve as both a gas-liquid separator and a refrigerant distributor. As shown in FIG. 5, the distributing part 20 includes an inlet pipe part 21, a first tray part 22 and a plurality of second tray parts 23.

As shown in FIG. 6, the inlet pipe part 21 extends generally parallel to the longitudinal center axis C of the shell 10. The inlet pipe part 21 is fluidly connected to the refrigerant inlet pipe 11 of the shell 10 so that the two-phase refrigerant is introduced into the inlet pipe part 21 via the refrigerant inlet pipe 11. The inlet pipe part 21 includes a plurality of openings 21*a* disposed along the longitudinal length of the inlet pipe part 21 for discharging the two-phase refrigerant. When the two-phase refrigerant is discharged from the openings 21*a* of the inlet pipe part 21, the liquid component of the two-phase refrigerant discharged from the openings 21*a* of the inlet pipe part 21 is received by the first tray part 22. On the other hand, the vapor component of the two-phase refrigerant flows upwardly and impinges the baffle member 50 shown in FIG. 7, so that liquid droplets entrained in the vapor are captured by the baffle member 50. The liquid droplets captured by the baffle member 50 are guided along a slanted surface of the baffle member 50 toward the first tray part 22. The baffle member 50 may be configured as a plate member, a mesh screen, or the like. The vapor component flows downwardly along the baffle member 50 and then changes its direction upwardly toward the outlet pipe 12. The vapor refrigerant is discharged toward the compressor 2 via the outlet pipe 12.

As shown in FIGS. 5 and 6, the first tray part 22 extends generally parallel to the longitudinal center axis C of the shell 10. As shown in FIG. 7, a bottom surface of the first tray part 22 is disposed below the inlet pipe part 21 to receive the liquid refrigerant discharged from the openings 21*a* of the inlet pipe part 21. In the first embodiment, the inlet pipe part 21 is disposed within the first tray part 22 so that no vertical gap is formed between the bottom surface of the first tray part 22 and the inlet pipe part 21 as shown in FIG. 7. In other words, in the first embodiment, a majority of the inlet pipe part 21 overlaps the first tray part 22 when viewed along a horizontal direction perpendicular to the longitudinal center axis C of the shell 10 as shown in FIG. 6. This arrangement is advantageous because an overall volume of the liquid refrigerant accumulated in the first tray part 22 can be reduced while maintaining a level (height) of the liquid refrigerant accumulated in the first tray part 22 relatively high. Alternatively, the inlet pipe part 21 and the first tray part 22 may be arranged such that a larger vertical gap is formed between the bottom surface of the first tray part 22 and the inlet pipe part 21. The inlet pipe part 21, the first tray part 22 and the baffle member 50 are preferably coupled together and suspended from above in an upper portion of the shell 10 in a suitable manner.

As shown in FIGS. 5 and 7, the first tray part 22 has a plurality of first discharge apertures 22*a* from which the liquid refrigerant accumulated therein is discharged downwardly. The liquid refrigerant discharged from the first discharge apertures 22*a* of the first tray part 22 is received by one of the second tray parts 23 disposed below the first tray part 22.

As shown in FIGS. 5 and 6, the distributing part 20 of the first embodiment includes three identical second try parts 23. The second tray parts 23 are aligned side-by-side along the longitudinal center axis C of the shell 10. As shown in FIG. 6, an overall longitudinal length of the three second tray parts 23 is substantially the same as a longitudinal length of the first tray part 22 as shown in FIG. 6. A transverse width of the second tray part 23 is set to be larger than a transverse width of the first tray part 22 so that the second tray part 23 extends over substantially an entire width of the tube bundle 30 as shown in FIG. 7. The second tray parts 23 are arranged so that the liquid refrigerant accumulated in the second tray parts 23 does not communicate between the second tray parts 23. As shown in FIGS. 5 and 7, each of the second tray parts 23 has a plurality of second discharge apertures 23*a* from which the liquid refrigerant is discharged downwardly toward the tube bundle 30.

It will be apparent to those skilled in the art from this disclosure that structure and configuration of the distributing part 20 are not limited to the ones described herein. Any conventional structure for distributing the liquid refrigerant downwardly onto the tube bundle 30 may be utilized to carry out the present invention. For example, a conventional distributing system utilizing spraying nozzles and/or spray tree tubes may be used as the distributing part 20. In other words, any conventional distributing system that is compatible with a falling film type evaporator can be used as the distributing part 20 to carry out the present invention.

The tube bundle 30 is disposed below the distributing part 20 so that the liquid refrigerant discharged from the distributing part 20 is supplied onto the tube bundle 30. The tube bundle 30 includes a plurality of heat transfer tubes 31 that extend generally parallel to the longitudinal center axis C of the shell 10 as shown in FIG. 6. The heat transfer tubes 31 are made of materials having high thermal conductivity, such as metal. The heat transfer tubes 31 are preferably provided with interior and exterior grooves to further promote heat exchange between the refrigerant and the water flowing inside the heat transfer tubes 31. Such heat transfer tubes including the interior and exterior grooves are well known in the art. For example, Thermoexel-E tubes by Hitachi Cable Ltd. may be used as the heat transfer tubes 31 of this embodiment. As shown in FIG. 5, the heat transfer tubes 31 are supported by a plurality of vertically extending support plates 32, which are fixedly coupled to the shell 10. In the first embodiment, the tube bundle 30 is arranged to form a two-pass system, in which the heat transfer tubes 31 are divided into a supply line group disposed in a lower portion of the tube bundle 30, and a return line group disposed in an upper portion of the tube bundle 30. As shown in FIG. 6, inlet ends of the heat transfer tubes 31 in the supply line group are fluidly connected to the water inlet pipe 15 via the inlet water chamber 13*a* of the connection head member 13 so that water entering the evaporator 1 is distributed into the heat transfer tubes 31 in the supply line group. Outlet ends of the heat transfer tubes 31 in the supply line group and inlet ends of the heat transfer tubes 31 of the return line tubes are fluidly communicated with a water chamber 14*a* of the return head member 14. Therefore, the water flowing inside the heat transfer tubes 31 in the supply line group is discharged into the water chamber 14*a*, and redistributed into the heat transfer tubes 31 in the return line group. Outlet ends of the heat transfer tubes 31 in the return line group are fluidly communicated with the water outlet pipe 16 via the outlet water chamber 13*b* of the connection head member 13. Thus, the water flowing inside the heat transfer tubes 31 in the return line group exits the evaporator 1 through the water outlet pipe 16. In a typical two-pass evaporator, the temperature of the water entering at the water inlet pipe 15 may be about 54 degrees F. (about 12° C.), and the water is cooled to about 44 degrees F. (about 7° C.) when it exits from the water outlet pipe 16. Although, in this embodiment, the evaporator 1 is arranged to form a two-pass system in which the water goes in and out on the same side of the evaporator 1, it will be apparent to those skilled in the art from this disclosure that the other conventional system such as a one-pass or three-pass system may be used. Moreover, in the two-pass system, the return line group may be disposed below or side-by-side with the supply line group instead of the arrangement illustrated herein.

The detailed arrangement for a heat transfer mechanism of the evaporator 1 according to the first embodiment will be explained with reference to FIG. 7. FIG. 7 is a simplified transverse cross sectional view of the evaporator 1 taken along a section line 7-7' in FIG. 3.

As described above, the refrigerant in a two-phase state is supplied through the supply conduit 6 to the inlet pipe part 21 of the distributing part 20 via the inlet pipe 11. In FIG. 7, the flow of refrigerant in the refrigeration circuit is schematically illustrated, and the inlet pipe 11 is omitted for the sake of brevity. The vapor component of the refrigerant supplied to the distributing part 20 is separated from the liquid component in the first tray section 22 of the distributing part 20 and exits the evaporator 1 through the outlet pipe 12. On the other hand, the liquid component of the two-phase refrigerant is accumulated in the first tray part 22 and then in the second tray parts 23, and discharged from the discharge apertures 23*a* of the second tray part 23 downwardly towards the tube bundle 30.

As shown in FIG. 7, the tube bundle 30 of the first embodiment includes a falling film region F and an accumulating region A. The heat transfer tubes 31 in the falling film region F are configured and arranged to perform falling film evaporation of the liquid refrigerant. More specifically, the heat transfer tubes 31 in the falling film region F are arranged such that the liquid refrigerant discharged from the distributing part 20 forms a layer (or a film) along an exterior wall of each of the heat transfer tubes 31, where the liquid refrigerant evaporates as vapor refrigerant while it absorbs heat from the water flowing inside the heat transfer tubes 31. As shown in FIG. 7, the heat transfer tubes 31 in the falling film region F are arranged in a plurality of vertical columns extending parallel to each other when seen in a direction parallel to the longitudinal center axis C of the shell 10 (as shown in FIG. 7). Therefore, the refrigerant falls downwardly from one heat transfer tube to another by force of gravity in each of the columns of the heat transfer tubes 31. The columns of the heat transfer tubes 31 are disposed with respect to the second discharge openings 23*a* of the second tray part 23 so that the liquid refrigerant discharged from the second discharge openings 23*a* is deposited onto an uppermost one of the heat transfer tubes 31 in each of the columns. In the first embodiment, the columns of the heat transfer tubes 31 in the falling film region F are arranged in a staggered pattern as shown in FIG. 7. In the first embodiment, a vertical pitch between two adjacent ones of the heat transfer tubes 31 in the falling film region F is substantially constant. Likewise, a horizontal pitch between two adjacent ones of the columns of the heat transfer tubes 31 in the falling film region F is substantially constant.

The liquid refrigerant that did not evaporate in the falling film region F continues falling downwardly by force of gravity into the accumulating region A, where the trough part 40 is provided as shown in FIG. 7. The trough part 40 is configured and arranged to accumulate the liquid refrigerant flowing from above so that the heat transfer tubes 31 in the accumulating region A are at least partially immersed in the liquid refrigerant that is accumulated in the trough part 40. A number of rows of the heat transfer tubes 31 in the accumulating region A, to which the trough part 40 is provided, is preferably about 10% to about 20% of a total number of rows of the heat transfer tubes 31 of the tube bundle 30. In other words, a ratio between the number of rows of the heat transfer tubes 31 in the accumulating region A and the number of the heat transfer tubes 31 in one of the columns in the falling film region F is preferably about 1:9 to about 2:8. Alternatively, when the heat transfer tubes 31 is arranged in an irregular pattern (e.g., the number of heat transfer tubes in each of the columns is different), a number of heat transfer tubes 31 disposed in the accumulating region A (i.e., at least partially immersed in the liquid refrigerant accumulated in the trough part 40) is preferably about 10% to about 20% of a total number of the heat transfer tubes in the tube bundle 30. In the example shown in FIG. 7, the trough part 40 is provided to two rows of the heat transfer tubes 31 in the accumulating region A, while each of the columns of the heat transfer tubes 31 in the falling film region F includes ten rows (i.e., the total number of rows in the tube bundle 30 is twelve). It will be apparent to those skilled in the art from this disclosure that, when the evaporator has a larger capacity and includes a larger number of heat transfer tubes, the number of columns of the heat transfer tubes in the falling film region F and/or the number of rows of the heat transfer tubes in the accumulating region A also increase.

As shown in FIG. 7, the trough part 40 includes a first trough section 41 and a pair of second trough sections 42. As seen in FIG. 6, the first trough section 41 and the second trough sections 42 extend generally parallel to the longitudinal center axis C of the shell 10 over a longitudinal length that is substantially the same as a longitudinal length of the heat transfer tubes 31. The first trough section 41 and the second trough sections 42 of the trough part 40 are spaced apart from an interior surface of the shell 10 when viewed along the longitudinal center axis C as seen in FIG. 7. The first trough section 41 and the second trough sections 42 may be made of a variety of materials such as metal, alloy, resin, etc. In the first embodiment, the first trough section 41 and the second trough sections 42 are made of metallic material, such as a steel plate (steel sheet). The first trough section 41 and the second trough sections 42 are supported by the support plates 32. The support plates 32 include openings (not shown) disposed at positions corresponding to an internal region of the first trough section 41 so that all segments of the trough section 41 are in fluid communication along the longitudinal length of the first trough section 41. Therefore, the liquid refrigerant accumulated in the first trough section 41 fluidly communicates via the openings in the support plates 32 along the longitudinal length of the trough section 41. Likewise, openings (not shown) are provided in the support plates 32 at positions corresponding to an internal region of each of the second trough sections 42 so that all segments of the second trough section 42 are in fluid communication along the longitudinal length of the second trough section 42. Therefore, the liquid refrigerant accumulated in the trough section 42 fluidly communicates via the openings in the support plates 32 along the longitudinal length of the second trough section 42.

As shown in FIG. 7, the first trough section 41 is disposed below the lowermost row of the heat transfer tubes 31 in the accumulating region A while the second trough sections 42 are disposed below the second lowermost row of the heat transfer tubes 31. As shown in FIG. 7, the second lowermost row in of the heat transfer tubes 31 in the accumulating region A is divided into two groups, and each of the second trough sections 42 is respectively disposed below each of the two groups. A gap is formed between the second trough sections 42 to allow an overflow of the liquid refrigerant from the second trough sections 42 toward the first trough section 41.

In the first embodiment, the heat transfer tubes 31 in the accumulating region A are arranged so that an outermost one of the heat transfer tubes 31 in each row of the accumulating region A is disposed outwardly of an outermost column of the heat transfer tubes 31 in the falling film region F on each side of the tube bundle 30 as shown in FIG. 7. Since the flow of liquid refrigerant tends to flare outwardly as it progresses toward the lower region of the tube bundle 30 due to vapor flow within the shell 10, it is preferable to provide at least one heat transfer tube in each row of the accumulating region A, which is disposed outwardly of the outermost column of the heat transfer tubes 31 in the falling film region F as shown in FIG. 7.

Figure 8:
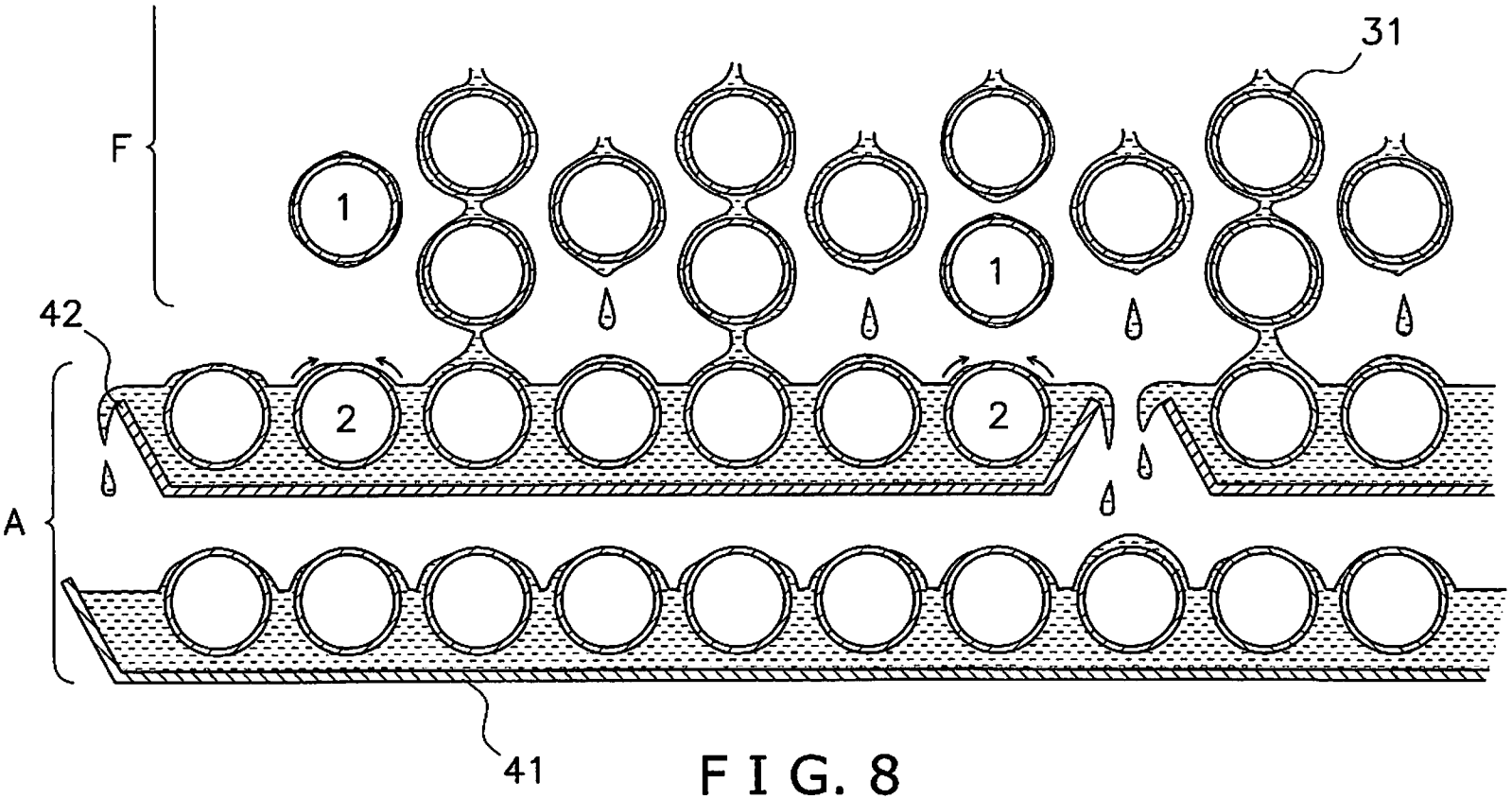
FIG. 8 is an enlarged schematic cross sectional view of heat transfer tubes and a trough part disposed in region X in FIG. 7 illustrating a state in which the heat exchanger is in use according to the first embodiment of the present invention.

FIG. 8 shows an enlarged cross sectional view of the region X in FIG. 7 schematically illustrating a state in which the evaporator 1 is in use under normal conditions. Water flowing inside the heat transfer tubes 31 is not illustrated in FIG. 8 for the sake of brevity. As shown in FIG. 8, the liquid refrigerant forms films along the exterior surfaces of the heat transfer tubes 31 in the falling film region F and part of the liquid refrigerant evaporates as the vapor refrigerant. However, an amount of the liquid refrigerant falling along the heat transfer tubes 31 decreases as it progresses toward the lower region of the tube bundle 30 while the liquid refrigerant evaporates as the vapor refrigerant. Moreover, if distribution of the liquid refrigerant from the distributing part 20 is not be even, there is more chance of formation of dry patches in the heat transfer tubes 31 disposed in a lower region of the tube bundle 30, which is detrimental to heat transfer. Thus, in the first embodiment of the present invention, the trough part 40 is provided in the accumulating region A, which is disposed in the lower region of the tube bundle 30, to accumulate the liquid refrigerant flowing from above and to redistribute the accumulated refrigerant along the longitudinal direction of the shell C. Therefore, all of the heat transfer tubes 31 in the accumulating region A are at least partially immersed in the liquid refrigerant collected in the trough part 40 according to the first embodiment. Thus, formation of dry patch in the lower region of the tube bundle 30 can be prevented, and good heat transfer efficiency of the evaporator 1 can be ensured.

For example, as shown in FIG. 8, when the heat transfer tubes 31 marked "1" receive little refrigerant, the heater transfer tubes 31 marked "2", which are disposed immediately below the ones marked "1," do not receive the liquid refrigerant from above. However, the liquid refrigerant is accumulated in the second trough sections 42 as the liquid refrigerant flows along the other heat transfer tubes 31. Therefore, the heat transfer tubes 31 immediately above the second trough sections 42 are at least partially immersed in the liquid refrigerant accumulated in the second trough sections 42. Moreover, even when the heat transfer tubes 31 are only partially immersed in the liquid refrigerant accumulated in the second trough section 42 (i.e., a part of each of the heat transfer tubes 31 is exposed), the liquid refrigerant accumulated in the trough sections 42 rises up along exposed surfaces of the exterior walls of the heat transfer tubes 31 as indicated by the arrows shown in FIG. 8 due to capillary action. Therefore, the liquid refrigerant accumulated in the second trough sections 42 boils and/or evaporates while absorbing heat from the water passing through the heat transfer tubes 31. Moreover, the second trough sections 42 are designed to allow the liquid refrigerant to overflow from the second trough sections 42 onto the first trough section 41. In order to readily receive the liquid refrigerant overflowed from the second trough section 42, outer edges of the first trough section 41 are disposed outwardly of outer edges of the second trough sections 42 as shown in FIGS. 7 and 8. The heat transfer tubes 31 that are disposed immediately above the first trough section 41 are at least partially immersed in the liquid refrigerant accumulated in the first trough section 41 as shown in FIG. 8. Moreover, even when the heat transfer tubes 31 are only partially immersed in the liquid refrigerant accumulated in the second trough section 41 (i.e., a part of each of the heat transfer tubes 31 is exposed), the liquid refrigerant in the trough section 41 rises up along exposed surfaces of the exterior walls of the heat transfer tubes 31 that are at least partially immersed in the accumulated refrigerant due to capillary action. Therefore, the liquid refrigerant accumulated in the first trough section 41 boils and/or evaporates while absorbing heat from the water passing inside the heat transfer tubes 31. Accordingly, heat transfer effectively takes place between the liquid refrigerant and the water flowing inside the heat transfer tubes 31 in the accumulating region A.

Figure 9:
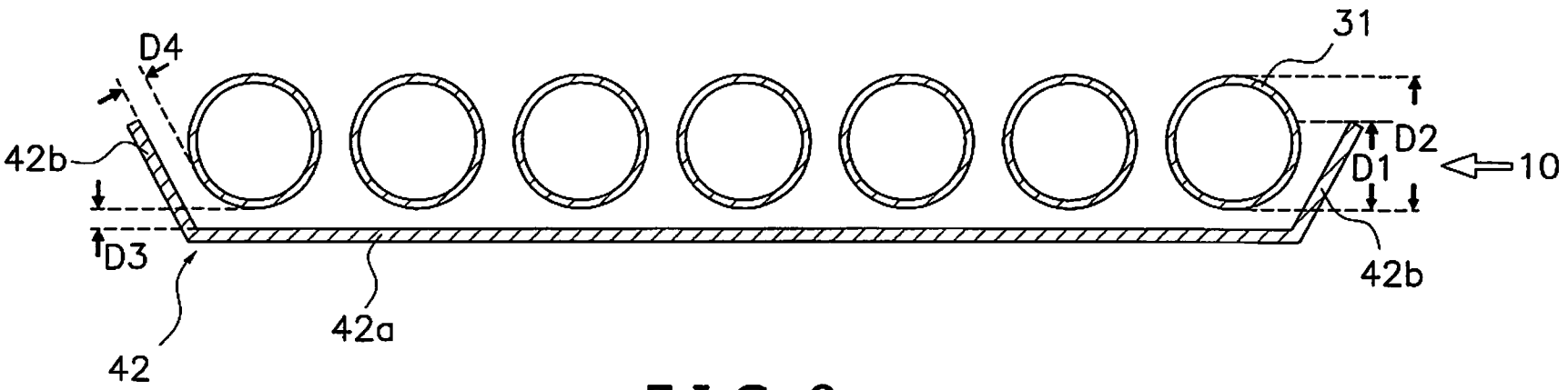
FIG. 9 is an enlarged cross sectional view of the heat transfer tubes and one of trough sections of a trough part according to the first embodiment of the present invention.
Figure 10:
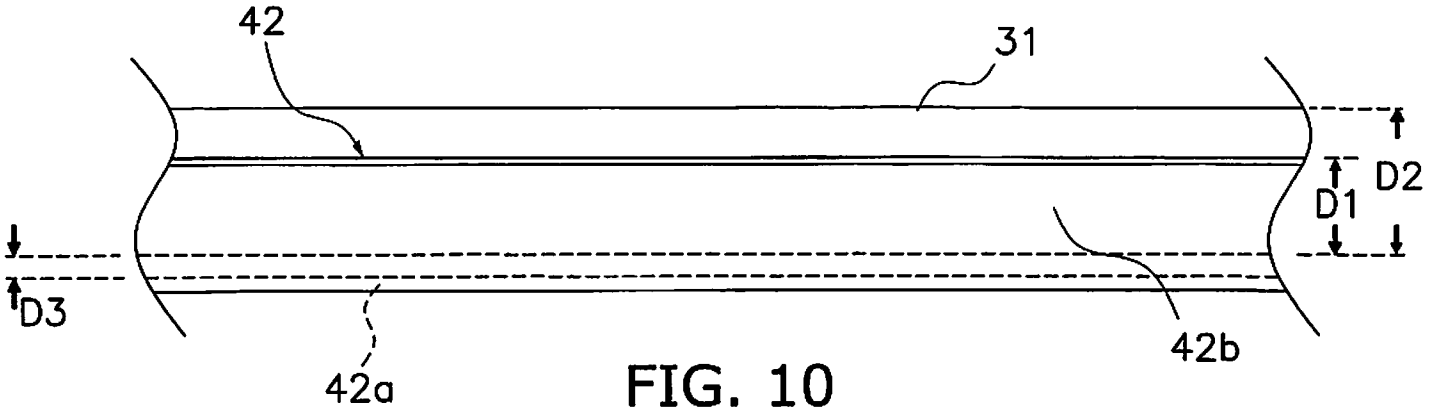
FIG. 10 is a partial side elevational view of the heat transfer tubes and the trough section according to the first embodiment of the present invention as seen in a direction along an arrow 10 in FIG. 9.
Figure 11B:
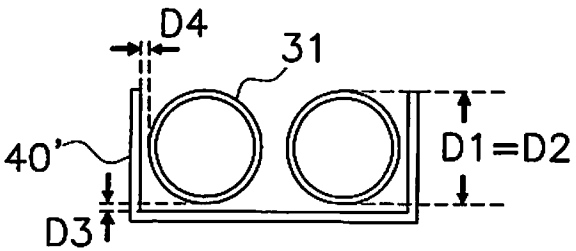
FIGS. 11B to 11D are simplified cross sectional views of the samples used to plot the graph shown in FIG. 11A.
Figure 11C:
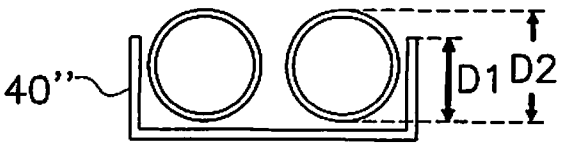
Figure 11D:
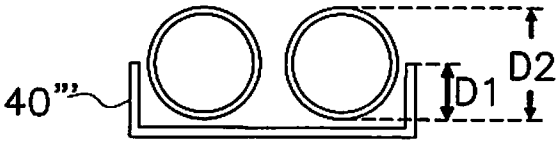

With reference to FIGS. 9 and 10, the detailed structure of the first trough section 41 and the second trough sections 42, and an arrangement of the first trough section 41 and the second trough sections 42 with respect to the heat transfer tubes 31 will be explained using one of the second trough sections 42 as an example. As seen in FIG. 9, the second trough section 42 includes a bottom wall portion 42*a* and a pair of side wall portions 42*b* extending upwardly from transverse ends of the bottom wall portion 42*a*. Although the side wall portions 42*b* have an upwardly tapered profile in the first embodiment, the shape of the second trough section 42 is not limited to this configuration. For example, the side wall portions 42*b* of the second trough section 42 may extend parallel to each other (see, FIG. 11B to 11D).

The bottom wall portion 42*a* and the side wall portions 42*b* form a recess in which the liquid refrigerant is accumulated so that the heat transfer tubes 31 are at least partially immersed in the liquid refrigerant accumulated in the second trough section 42 when the evaporator 1 is operated under normal conditions. More specifically, the side wall portions 42*b* of the second trough part 42 partially overlap with the heat transfer tubes 31 disposed directly above the second trough part 42 when viewed along a horizontal direction perpendicular to the longitudinal center axis C of the shell 10. FIG. 10 shows the trough section 42 and the heat transfer tubes 31 when viewed along the horizontal direction perpendicular to the longitudinal center axis C of the shell 10. An overlapping distance D1 between the side wall portions 42*b* and the heat transfer tubes 31 disposed immediately above the second trough section 42 as viewed along the horizontal direction perpendicular to the longitudinal center axis C of the shell 10 is set such that the heat transfer tubes 31 are at least partially immersed in the liquid refrigerant accumulated in the second trough section 42. The overlapping distance D1 is also set so that the liquid refrigerant reliably overflows from the second trough section 42 when the evaporator 1 runs under normal conditions. Preferably, the overlapping distance D1 is set to be equal to or greater than one-half of a height (outer diameter) D2 of the heat transfer tube 31 ($D1/D2 \geq 0.5$). More preferably, the overlapping distance D1 is set to be equal to or greater than three-quarters of the height (outer diameter) of the heat transfer tube 31 ($D1/D2 \geq 0.75$). In other words, the second trough section 42 is arranged such that, when the second trough section 42 is filled with the liquid refrigerant to the brim, at least one-half (or, more preferably, at least three-quarters) of the height (outer diameter) of each of the heat transfer tubes 31 are immersed in the liquid refrigerant. The overlapping distance D1 may be equal to or greater than the height D2 of the heat transfer tube 31. In such a case, the heat transfer tubes 31 are completely immersed in the liquid refrigerant accumulated in the second trough section 42. However, since the amount of refrigerant charge increases as the capacity of the second trough section 42 increases, it is preferable that the overlapping distance D1 is substantially equal to or smaller than the height D2 of the heat transfer tube 31.

A distance D3 between the bottom wall portion 42*a* and the heat transfer tubes 31 and a distance D4 between the side wall portion 42*b* and the heat transfer tube 31 are not limited to any particular distance as long as a sufficient space is formed between the heat transfer tubes 31 and the second trough section 42 to allow the liquid refrigerant flow between the heat transfer tubes 31 and the second trough section 42. For example, each of the distance D3 and the distance D4 may be set to about 1 mm to about 4 mm. Moreover, the distance D3 and the distance D4 may be the same or different.

The first trough section 41 includes the similar structure as the second trough section 42 as described above except that the height of the first trough section 41 may be the same or different from the height of the second trough section. Since the first trough section 41 is disposed below the lowermost row of the heat transfer tubes 31, it is not necessary to overflow the liquid refrigerant from the first trough section 41. Therefore, an overall height of the first trough section 41 may be set to be higher than that of the second trough section 42. In any event, it is preferable that the overlapping distance D1 between the first trough section 41 and the heat transfer tubes 31 is set to be equal to or greater than one-half (or, more preferably, three-quarters) of the height (outer diameter) D2 of the heat transfer tube 31 as explained above.

Figure 11A:
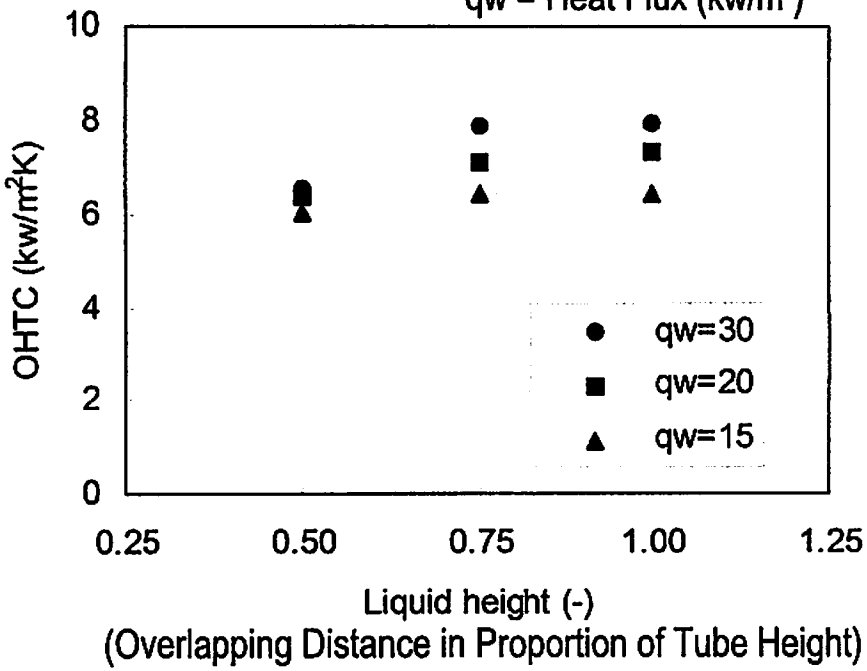
FIG. 11A is a graph of an overall heat transfer coefficient versus an overlapping distance between the trough part and the heat transfer tube according to the first embodiment of the present invention.

FIG. 11A is a graph of an overall heat transfer coefficient versus the overlapping distance D1 between a trough section and the heat transfer tube 31 according to the first embodiment. In the graph shown in FIG. 11A, the vertical axis indicates the overlapping heat transfer coefficient (kw/m$^2$K) and the horizontal axis indicates the overlapping distance D1 as expressed by a proportion of the height D2 of the heat transfer tube 31. An experiment was conducted to measure the overall heat transfer coefficient by using three samples shown in FIG. 11B to 11D. In the first sample shown in FIG. 11B, the overlapping distance D1 between a trough part 40' and the heat transfer tube 31 was equal to the height D2 of the heat transfer tube 31, and thus, the overlapping distance expressed by a proportion of the height of the heat transfer tube 31 was 1.0. In the second sample shown in FIG. 11C, the overlapping distance D1 between a trough part 40" and the heat transfer tube 31 was equal to three-quarters (0.75) of the height D2 of the heat transfer tube 31. In the third sample shown in FIG. 11D, the overlapping distance D1 between a trough part 40''' and the heat transfer tube 31 was equal to one-half (0.5) of the height D2 of the heat transfer tube 31. In the first to third samples shown in FIGS. 11B to 11D, a distance D3 between the bottom wall of the trough section and the heat transfer tube 31 and a distance D4 between the side wall of the trough section and the heat transfer tube 31 were about 1 mm. The first to third samples were filled with the liquid refrigerant (R-134a) to the brim, and the overall heat transfer coefficient was measured under different heat flux levels (30 kw/m$^2$, 20 kw/m$^2$, and 15 kw/m$^2$).

As shown in the graph of FIG. 11A, the overall heat transfer coefficient in the second sample with the overlapping distance of 0.75 (FIG. 11C) was substantially the same as the overall heat transfer coefficient of the first sample with the overlapping distance of 1.0 (FIG. 11B) under all heat flux levels. Moreover, the overall heat transfer coefficient in the third sample with the overlapping distance of 0.5 (FIG. 11D) was about 80% of the overall heat transfer coefficient as the first sample (FIG. 11B) under the higher heat flux level (30 kw/m$^2$), and the overall heat transfer coefficient in the third sample (FIG. 11D) was about 90% of the overall heat transfer coefficient of the first sample (FIG. 11B) under the lower heat flux level (20 kw/m$^2$). In other words, there was no drastic decrease in performance even when the overlapping distance D1 was one-half (0.5) of the height of the heat transfer tube 31. Accordingly, the overlapping distance D1 is preferably set to be equal to or greater than one-half (0.5), and more preferably equal to or greater than three-quarters (0.75), of the height of the heat transfer tube 31.

With the evaporator 1 according to the first embodiment, the liquid refrigerant is accumulated in the trough part 40 in the accumulating region A so that the heat transfer tubes 31 disposed in a lower region of the tube bundle 30 are at least partially immersed in the liquid refrigerant accumulated in the trough part. Therefore, even when the liquid refrigerant is not evenly distributed from above, formation of dry patches in the lower region of the tube bundle 30 can be readily prevented. Moreover, with the evaporator 1 according to the first embodiment, since the trough part 40 is disposed adjacent to the heat transfer tubes 31 and spaced apart from the interior surface of the shell 10, the amount of refrigerant charge can be greatly reduced as compared to a conventional hybrid evaporator including a flooded section, which forms a pool of refrigerant at a bottom portion of an evaporator shell, while ensuring good heat transfer performance.

The arrangements for the tube bundle 30 and the trough part 40 are not limited to the ones illustrated in FIG. 7. It will be apparent to those skilled in the art from this disclosure that various changes and modifications can be made herein without departing from the scope of the invention. Several modified examples will be explained with reference to FIGS. 12 to 18.

Figure 12:
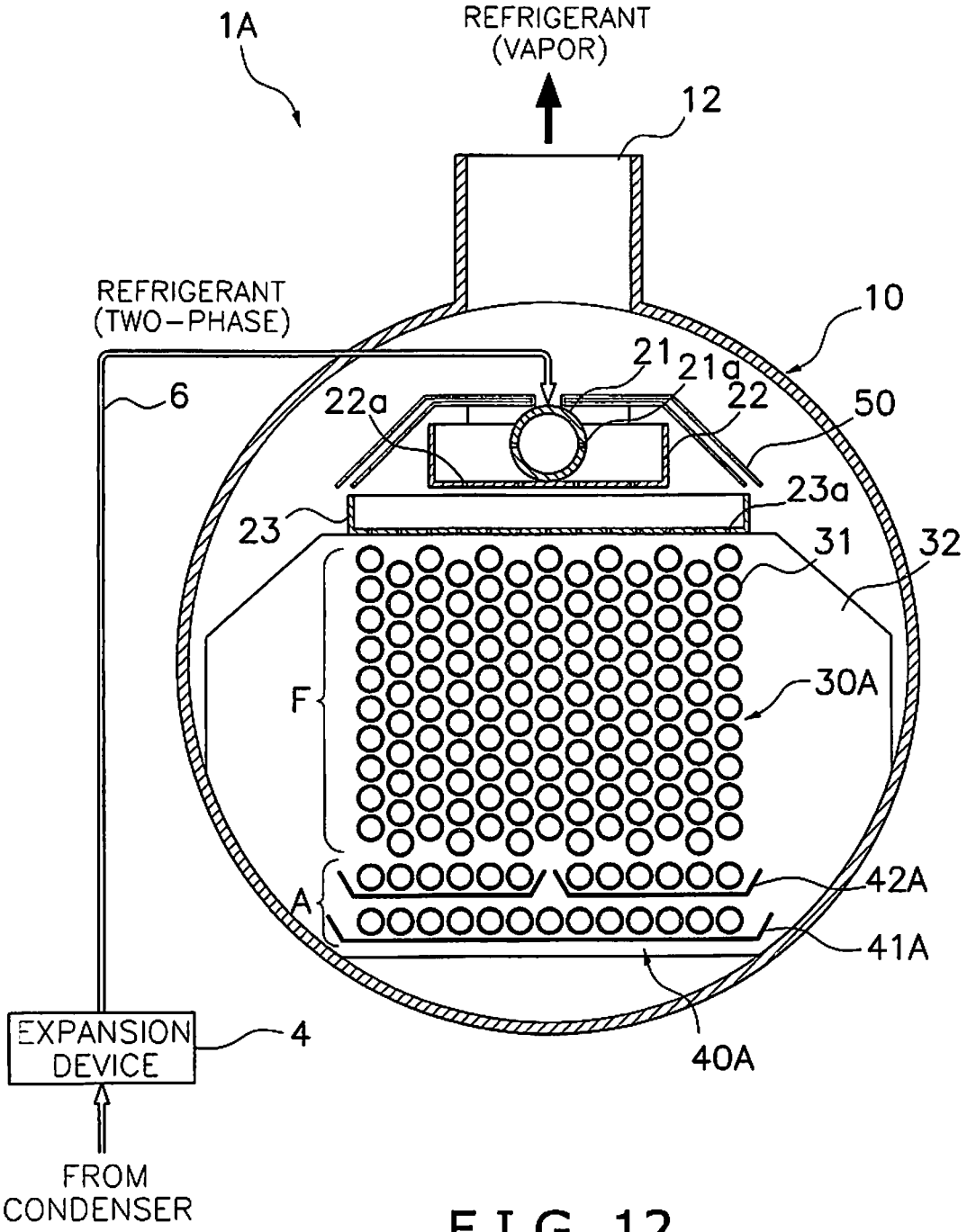
FIG. 12 is a simplified transverse cross sectional view of the heat exchanger illustrating a first modified example for an arrangement of a tube bundle and a trough part according to the first embodiment of the present invention.

FIG. 12 is a simplified transverse cross sectional view of an evaporator 1A illustrating a first modified example for an arrangement of a tube bundle 30A and a trough part 40A according to the first embodiment. The evaporator 1A is basically the same as the evaporator 1 illustrated in FIGS. 2 to 7 except that the outermost one of the heat transfer tubes 31 in the accumulating region A in each row is vertically aligned with the outermost column of the heat transfer tubes 31 in the falling film region F on each side of the tube bundle 30A as shown in FIG. 12. In such a case too, since outermost ends of second trough sections 42A extend outwardly, the liquid refrigerant can be readily received by the second trough sections 42A even when the flow of liquid refrigerant flares outwardly as it progresses toward the lower region of the tube bundle 30A.

Figure 13:
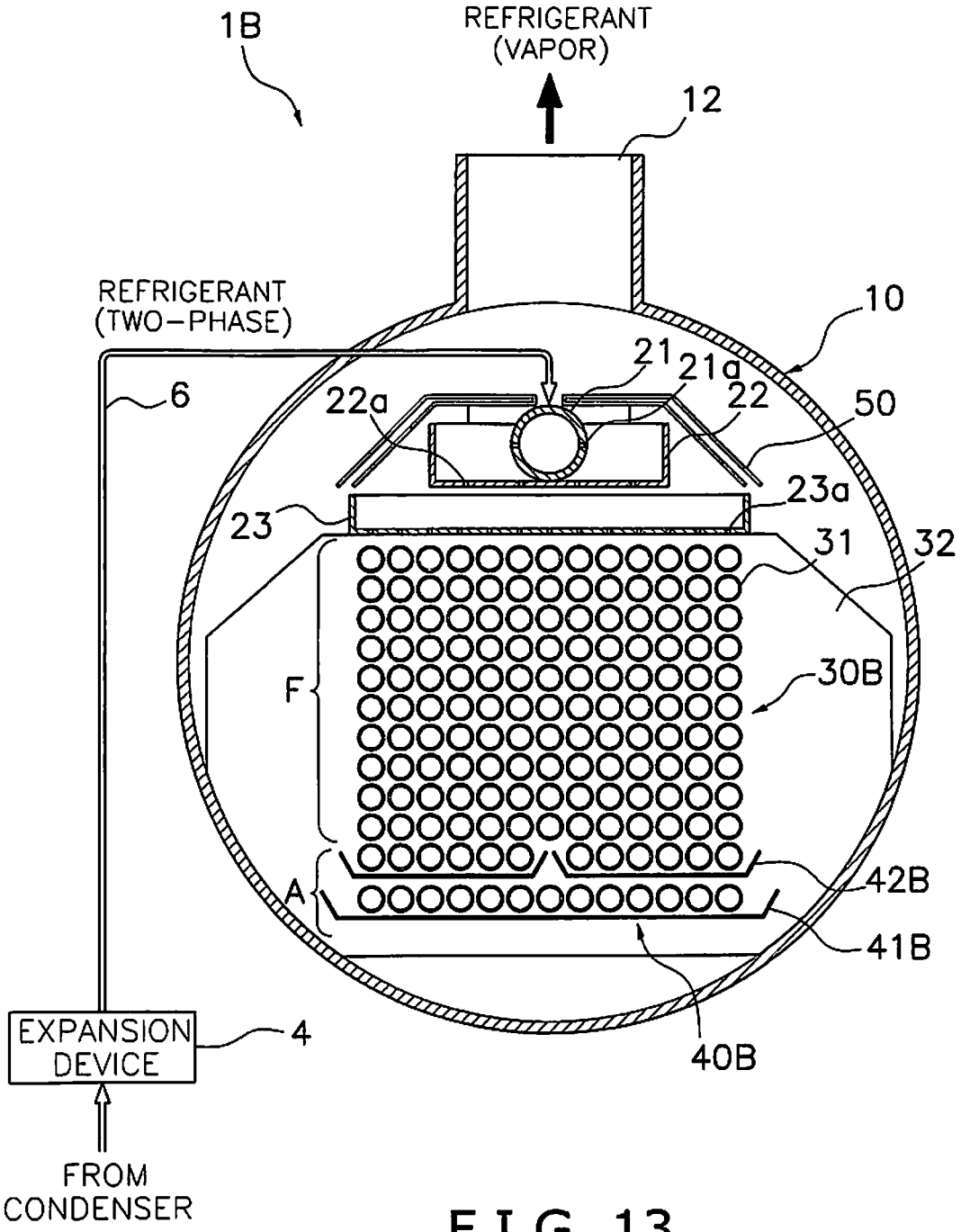
FIG. 13 is a simplified transverse cross sectional view of the heat exchanger illustrating a second modified example for an arrangement of a tube bundle and a trough part according to the first embodiment of the present invention.

FIG. 13 is a simplified transverse cross sectional view of an evaporator 1B illustrating a second modified example for an arrangement of a tube bundle 30B and a trough part 40B according to the first embodiment. The evaporator 1B is basically the same as the evaporator 1A shown in FIG. 12 except that the heat transfer tubes 31 of the tube bundle 30B in the falling film region F are arranged not in a staggered pattern, but in a matrix as shown in FIG. 13.

Figure 14:
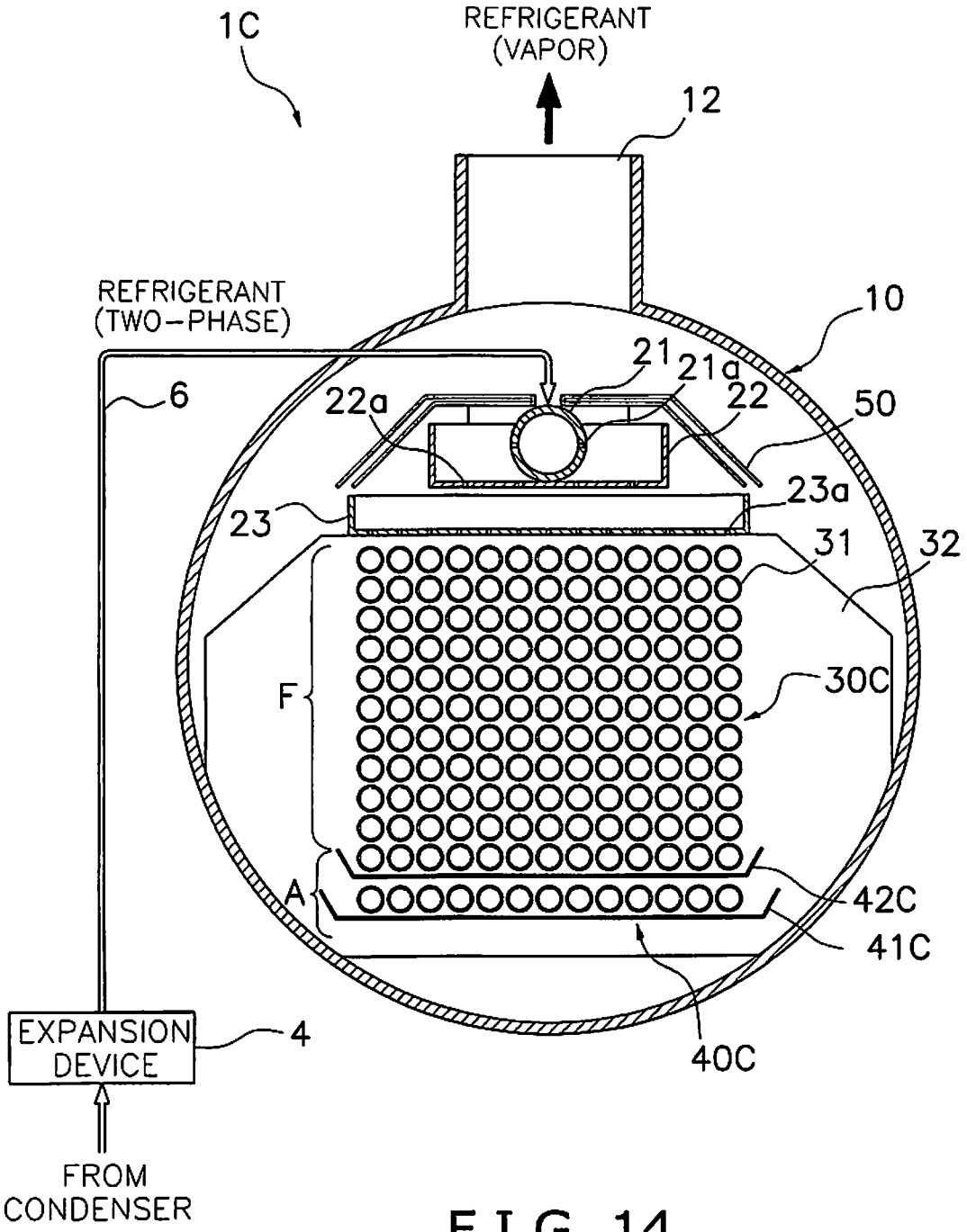
FIG. 14 is a simplified transverse cross sectional view of the heat exchanger illustrating a third modified example for an arrangement of a tube bundle and a trough part according to the first embodiment of the present invention.

FIG. 14 is a simplified transverse cross sectional view of an evaporator 1C illustrating a third modified example for an arrangement of a tube bundle 30C and a trough part 40C according to the first embodiment. The evaporator 1C is basically the same as the evaporator 1B shown in FIG. 13 except that the trough part 40C includes a single second trough section 42C that extends continuously in the transverse direction. In such a case too, the liquid refrigerant accumulated in the second trough section 42C overflows from both transverse sides of the second trough section 42C towards a first trough section 41C.

Figure 15:
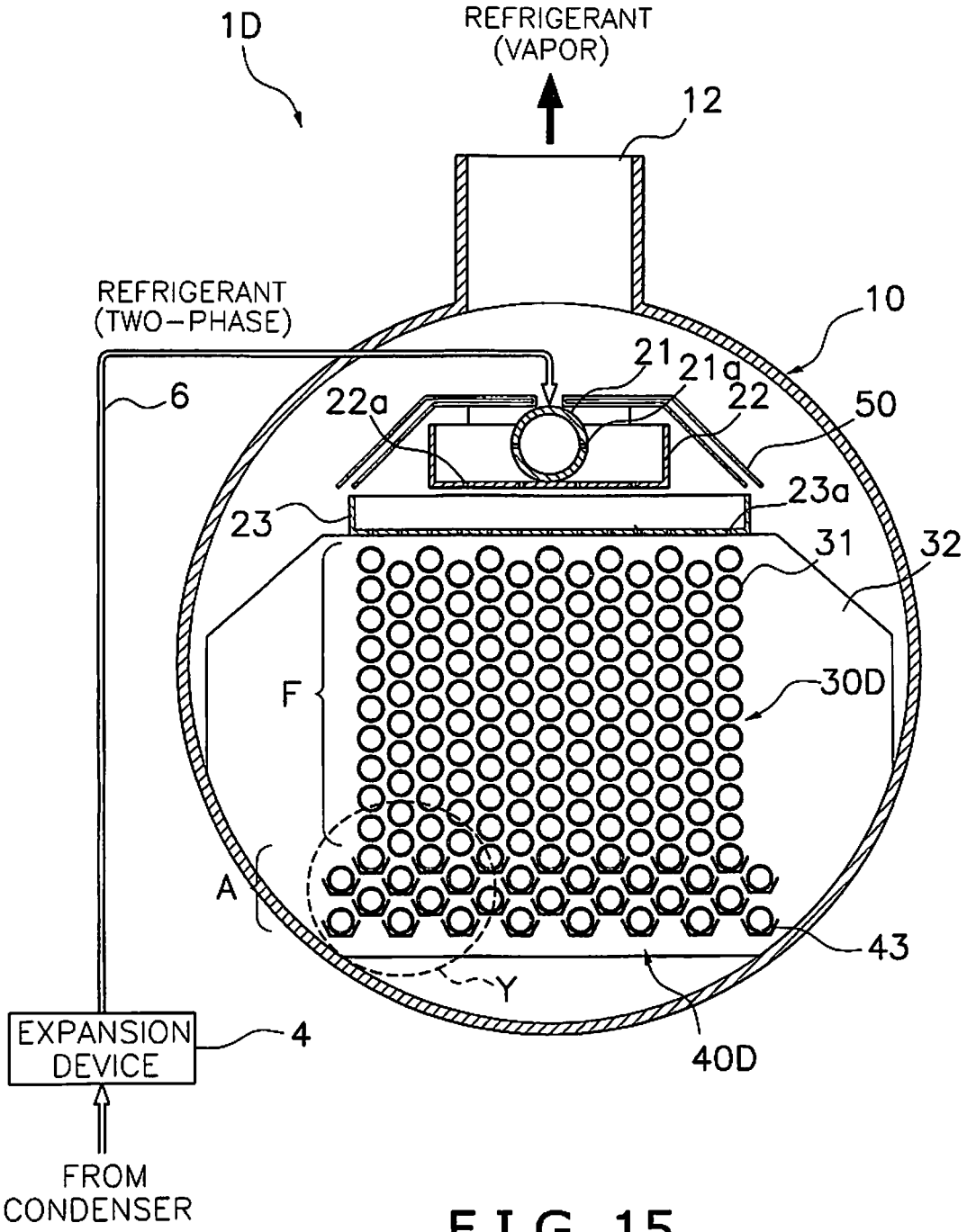
FIG. 15 is a simplified transverse cross sectional view of the heat exchanger illustrating a fourth modified example for an arrangement of a tube bundle and a trough part according to the first embodiment of the present invention.
Figure 16:
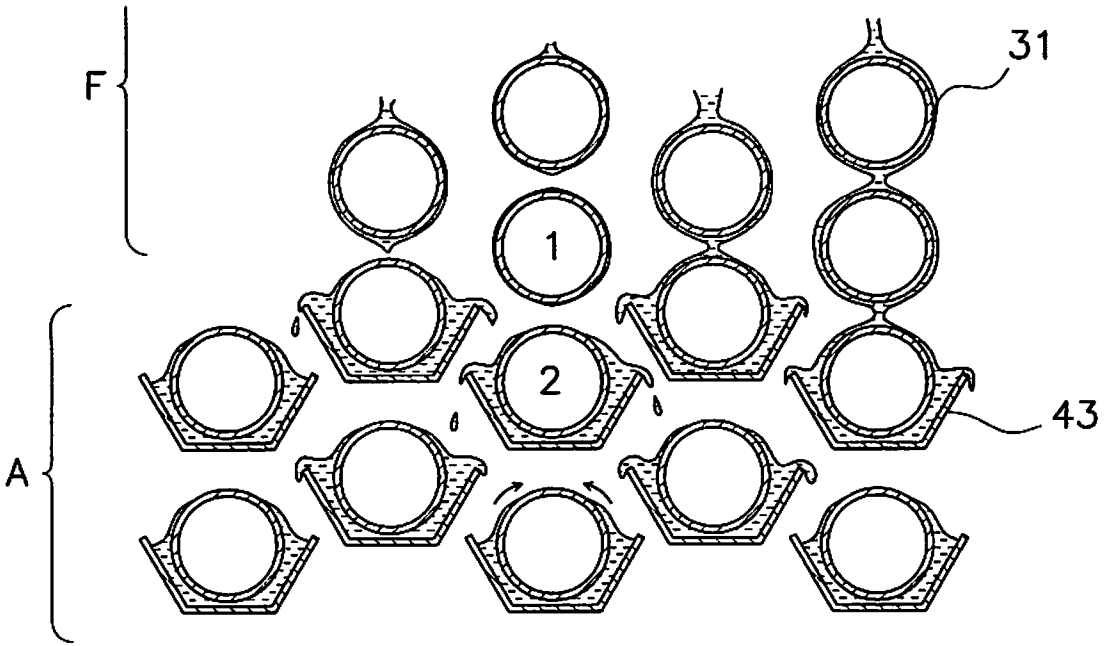
FIG. 16 is an enlarged schematic cross sectional view of the heat transfer tubes and trough sections disposed in region Y in FIG. 15 illustrating a state in which the heat exchanger is in use according to the first embodiment of the present invention.

FIG. 15 is a simplified transverse cross sectional view of an evaporator 1D illustrating a fourth modified example for an arrangement of a tube bundle 30D and a trough part 40D according to the first embodiment. In the example shown in FIG. 15, the trough part 40D includes a plurality of individual trough sections 43 that are disposed respectively below the heat transfer tubes 31 in the accumulating region A. FIG. 16 is an enlarged schematic cross sectional view of the heat transfer tubes 31 and the trough sections 43 disposed in region Y in FIG. 15 illustrating a state in which the evaporator 1D is in use. The liquid refrigerant accumulated in the trough sections 43 in the uppermost row in the accumulating region A overflows towards the trough sections 43 disposed downwardly as shown in FIG. 16. Therefore, all of the heat transfer tubes 31 in the accumulating region A are at least partially immersed in the liquid refrigerant accumulated in the trough sections 43. Accordingly, the liquid refrigerant evaporates as the vapor refrigerant as heat transfer takes place between the liquid refrigerant and the water flowing inside the heat transfer tubes 31.

The shape of the trough section 43 is not limited to the configuration illustrated in FIGS. 15 and 16. For example, a cross section of the trough section 43 may have C-shape, V-shape, U-shape or the like. Similarly to the example discussed above, the overlapping distance between the trough section 43 and the heat transfer tube 31 disposed directly above the trough section 43 is preferably set to be equal to or greater than one-half (0.5), and more preferably equal to or greater than three-quarters (0.75), of the height of the heat transfer tube 31 as viewed along the horizontal direction perpendicular to the longitudinal center axis C.

Figure 17:
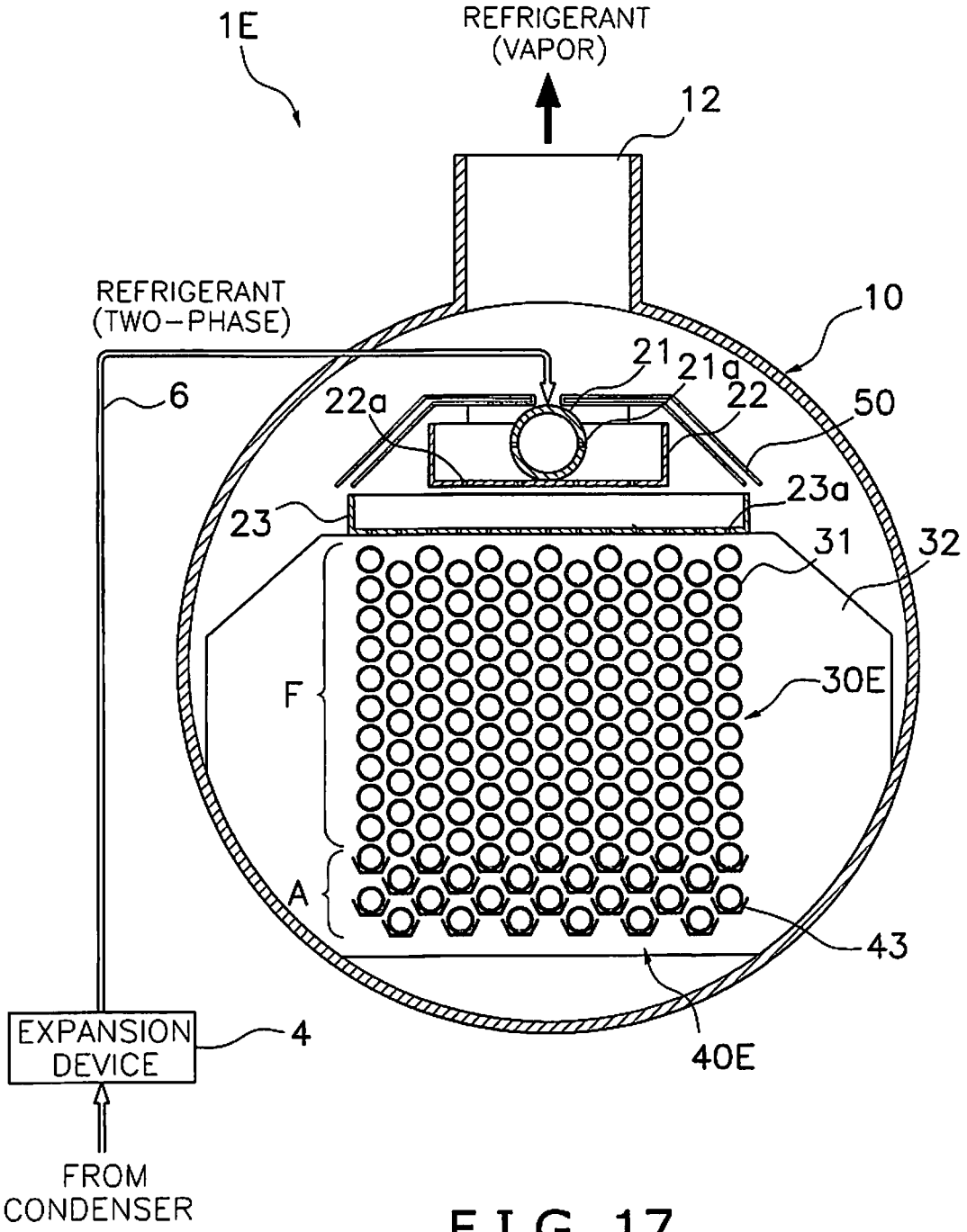
FIG. 17 is a simplified transverse cross sectional view of the heat exchanger illustrating a fifth modified example for an arrangement of a tube bundle and a trough part according to the first embodiment of the present invention.

FIG. 17 is a simplified transverse cross sectional view of an evaporator 1E illustrating a fifth modified example for an arrangement of a tube bundle 30E and a trough part 40E according to the first embodiment. The evaporator 1E is basically the same as the evaporator 1D illustrated in FIG. 16 except that the outermost one of the heat transfer tubes 31 in the accumulating region A in each row is vertically aligned with the outermost column of the heat transfer tubes 31 in the falling film region F on each side of the tube bundle 30E as shown in FIG. 17.

Figure 18:
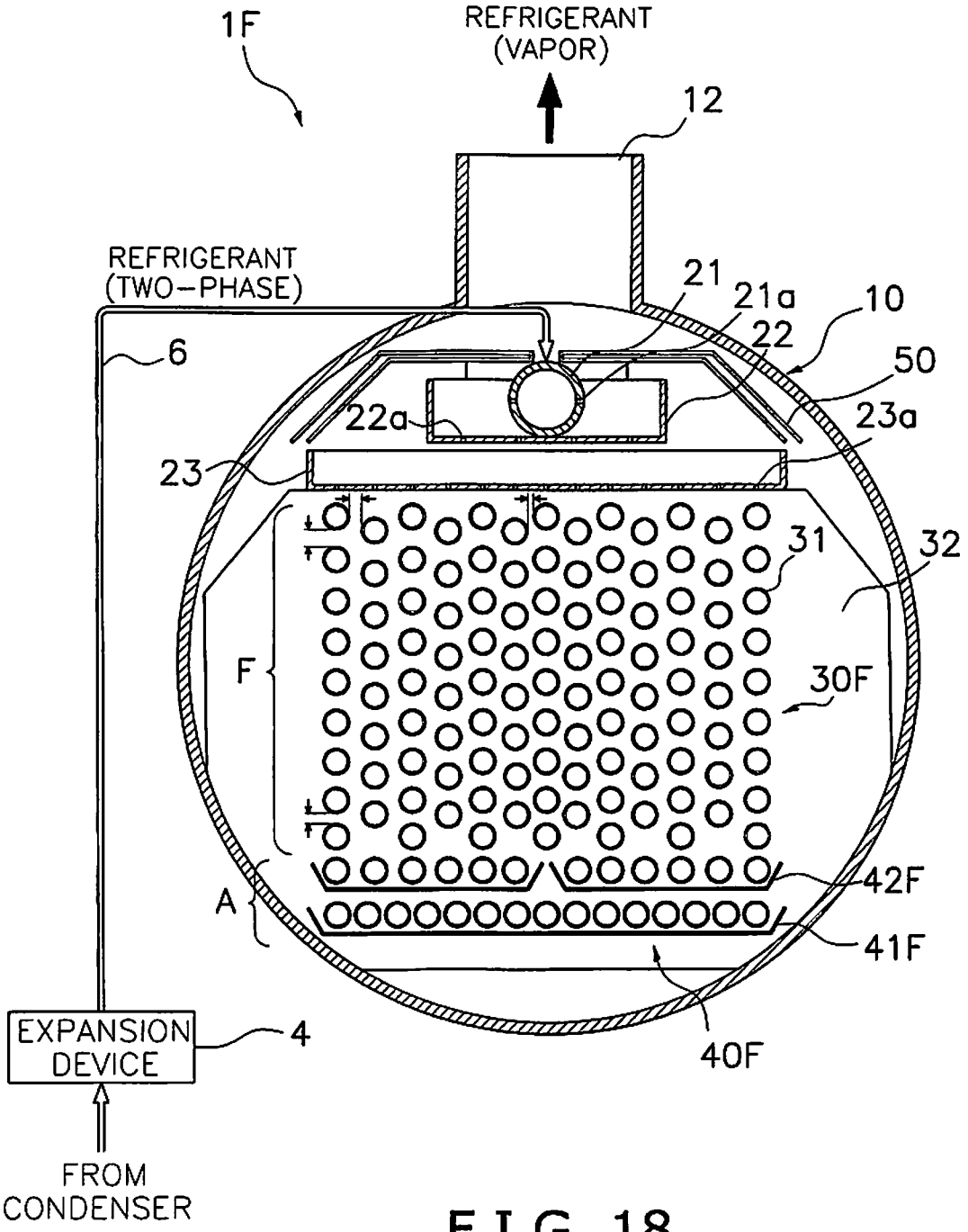
FIG. 18 is a simplified transverse cross sectional view of the heat exchanger illustrating a sixth modified example for an arrangement of a tube bundle and a trough part according to the first embodiment of the present invention.

FIG. 18 is a simplified transverse cross sectional view of an evaporator 1F illustrating a sixth modified example for an arrangement of a tube bundle 30F and a trough part 40F according to the first embodiment. The evaporator 1A is basically the same as the evaporator 1 illustrated in FIGS. 2 to 7 except for an arrangement pattern of the heat transfer tubes 31 in the falling film region F. More specifically, in the example shown in FIG. 18, the heat transfer tubes 31 in the falling film region F are arranged so that a vertical pitch between two adjacent ones of the heat transfer tubes 31 in each column is larger in an upper region of the falling film region F than in a lower region of the falling film region F. Moreover, the heat transfer tubes 31 in the falling film region F are arranged so that a horizontal pitch between two adjacent columns of the heat transfer tubes is larger in a transverse center region of the falling film region F than in an outer region of the falling film region F.

An amount of vapor flow in the shell 10 tends to be larger in the upper region of the falling film region F than in the lower region of the falling film region F. Likewise, the amount of vapor flow in the shell 10 tends to be larger in the transverse center region of the falling film region F than in the outer region of the falling film region F. Therefore, the vapor velocity in the upper region and the outer region of the falling film region F often become very high. As a result, the transverse vapor flow causes disruption of the vertical flow of the liquid refrigerant between the heat transfer tubes 31. Moreover, the liquid refrigerant may be carried over by the high velocity vapor flow to the compressor 2, and the entrained liquid refrigerant may damage the compressor 2. Accordingly, in the example shown in FIG. 18, the vertical pitch and the horizontal pitch of the heat transfer tubes 31 are adjusted to enlarge cross sectional areas of vapor passages formed between the heat transfer tubes 31 in the upper region and the outer region of the falling film region F. Accordingly, the velocity of the vapor flow in the upper region and the outer region of the falling film region F can be decreased. Therefore, disruption of vertical flow of the liquid refrigerant and occurrence of entrained liquid refrigerant by the vapor flow can be prevented.

Second Embodiment

Figure 19:
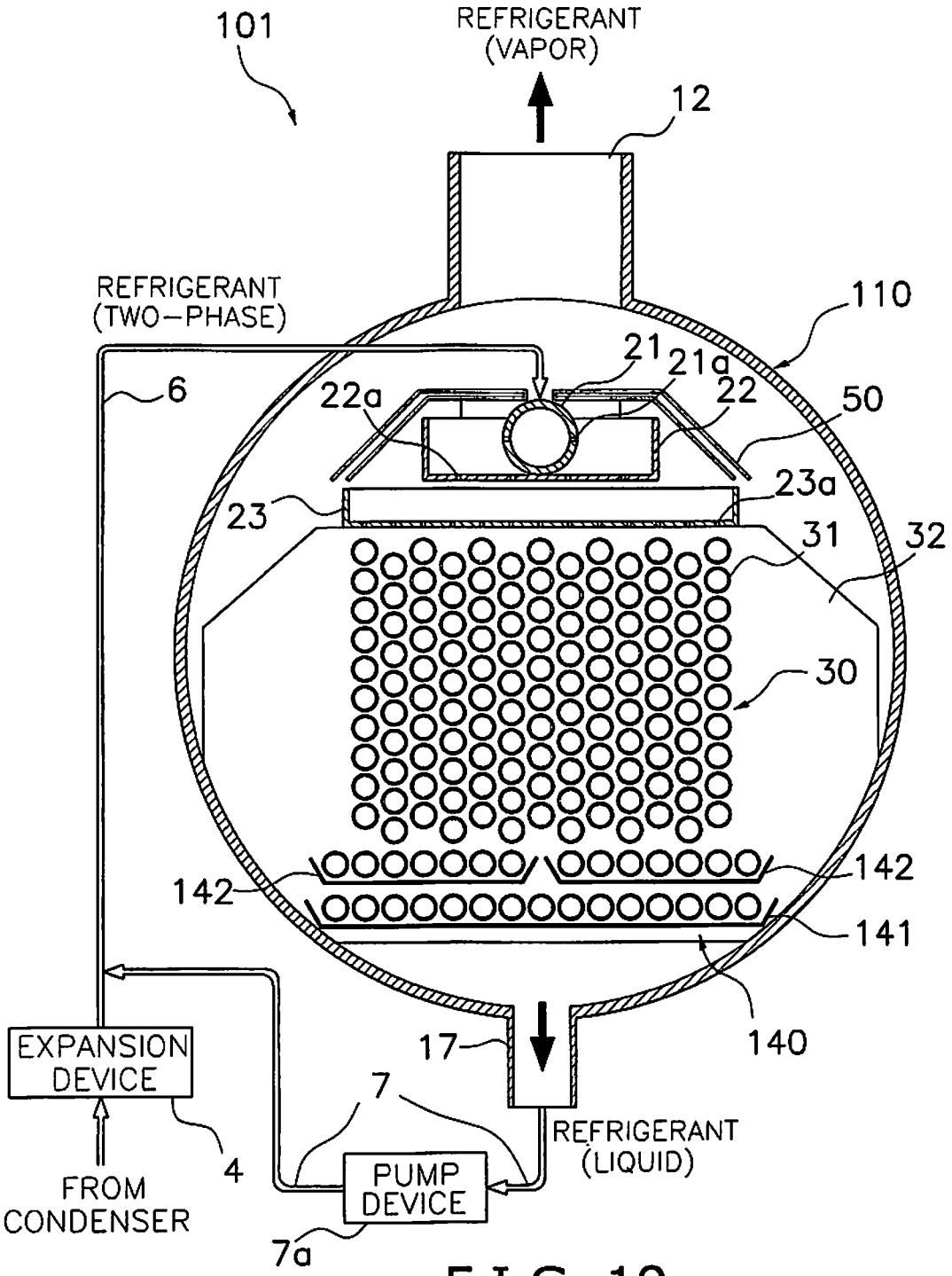
FIG. 19 is a simplified transverse cross sectional view of a heat exchanger according to a second embodiment of the present invention.

Referring now to FIG. 19, an evaporator 101 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

The evaporator 101 according to the second embodiment is basically the same as the evaporator 1 of the first embodiment except that the evaporator 101 of the second embodiment is provided with a refrigerant recirculation system. A trough part 140 of the second embodiment is basically the same as the trough part 40 of the first embodiment. In the first embodiment as described above, if the liquid refrigerant is distributed from the distributing part 20 over the tube bundle 30 relatively uniformly (e.g., ±10%), the refrigerant charge can be set to a prescribed amount with which almost all the liquid refrigerant evaporates in the falling film region F or the accumulating region A. In such a case, there is little liquid refrigerant that overflows from the first trough section 41 towards the bottom portion of the shell 10. However, when distribution of the liquid refrigerant from the distributing part 20 over the tube bundle 30 is significantly uneven (e.g., ±20%), there is a greater chance of dry patches being formed in the tube bundle 30. Therefore, in such a case, more than the prescribed amount of refrigerant needs to be supplied to the system in order to prevent formation of the dry patches. Thus, in the second embodiment, the refrigerant recirculation system is provided to the evaporator 101 for recirculating the liquid refrigerant, which has overflowed from the trough part 140 and accumulated in a bottom portion of a shell 110. The shell 110 includes a bottom outlet pipe 17 in fluid communication with a conduit 7 that is coupled to a pump device 7*a* as shown in FIG. 19. The pump device 7*a* is selectively operated so that the liquid refrigerant accumulated in the bottom portion of the shell 110 recirculates back to the distribution part 20 of the evaporator 110 via the conduit 6 and the inlet pipe 11 (FIG. 1). The bottom outlet pipe 17 may be placed at any longitudinal position of the shell 110.

Alternatively, the pump device 7*a* may be replaced by an ejector device which operates on Bernoulli's principal to draw the liquid refrigerant accumulated in the bottom portion of the shell 110 using the pressurized refrigerant from the condenser 3. Such an ejector device combines the functions of an expansion device and a pump.

Accordingly, with the evaporator 110 according to the second embodiment, the liquid refrigerant that did not evaporate can be efficiently recirculated and reused for heat transfer, thereby reducing the amount of refrigerant charge.

In the second embodiment, the arrangements for a tube bundle 130 and the trough part 140 are not limited to the ones illustrated in FIG. 19. It will be apparent to those skilled in the art from this disclosure that various changes and modifications can be made herein without departing from the scope of the invention. For example, the arrangements of the tube bundle and the trough part shown in FIGS. 12-15, 17 and 18 can also be used in the evaporator 110 according to the second embodiment.

Third Embodiment

Referring now to FIGS. 20 to 25, an evaporator 201 in accordance with a third embodiment will now be explained. In view of the similarity between the first, second and third embodiments, the parts of the third embodiment that are identical to the parts of the first or second embodiment will be given the same reference numerals as the parts of the first or second embodiment. Moreover, the descriptions of the parts of the third embodiment that are identical to the parts of the first or second embodiment may be omitted for the sake of brevity.

The evaporator 201 of the third embodiment is similar to the evaporator 101 of the second embodiment in that the evaporator 201 is provided with the refrigerant recirculation system, which recirculates the liquid refrigerant accumulated at the bottom portion of a shell 210 via the bottom outlet pipe 17 and the conduit 7. When the compressor 2 (FIG. 1) of the vapor compression system utilizes lubrication oil, the oil tends to migrate from the compressor 2 into the refrigeration circuit of the vapor compression system. In other words, the refrigerant that enters the evaporator 201 contains the compressor oil (refrigerant oil). Therefore, when the refrigerant recirculation system is provided in the evaporator 201, the oil is recirculated within the evaporator 201 along with the liquid refrigerant, which causes high concentration of the oil in the liquid refrigerant in the evaporator 201, thereby decreasing performance of the evaporator 201. Therefore, the evaporator 201 of the third embodiment is configured and arranged to accumulate the oil using a trough part 240, and discharge the accumulated oil outside of the evaporator 201 toward the compressor 2.

More specifically, the evaporator 201 includes the trough part 240 that is disposed below a part of the lowermost row of the heat transfer tubes 31 in a tube bundle 230. The trough part 240 is fluidly connected to a valve device 8*a* via a bypass conduit 8. The valve device 8*a* is selectively operated when the oil accumulated in the trough part 240 reaches a prescribed level to discharge the oil from the trough part 240 to outside of the evaporator 201.

As mentioned above, when the refrigerant that enters the evaporator 201 contains the compressor oil, the oil is recirculated with the liquid refrigerant by the refrigerant recirculation system. In the third embodiment, the trough part 240 is arranged such that the liquid refrigerant accumulated in the trough part 240 does not overflow from the trough part 240. The accumulated liquid refrigerant in the trough part 240 boils and/or evaporates as it absorbs heat from the water flowing inside the heat transfer tubes 31 immersed in the accumulated liquid refrigerant, while the oil remains in the trough part 240. Therefore, concentration of the oil in the trough part 240 gradually increases as recirculation of the liquid refrigerant in the evaporator 201 progresses. Once an amount of the oil accumulated in the trough part 240 reaches a prescribed level, the valve device 8*a* is operated and the oil is discharged from the evaporator 201. Similarly to the first embodiment, the overlapping distance between the trough part 240 of the third embodiment and the heat transfer tube 31 disposed directly above the trough part 240 is preferably set to be equal to or greater than one-half (0.5), and more preferably equal to or greater than three-quarters (0.75), of the height of the heat transfer tube 31 as viewed along the horizontal direction perpendicular to the longitudinal center axis C.

In the third embodiment, a region of a tube bundle 230 where the trough part 240 is disposed constitutes the accumulating region A while the rest of the tube bundle 230 constitutes the falling film region F.

Accordingly, with the evaporator 201 of the third embodiment, the compressor oil that has been migrated from the compressor 2 to the refrigeration circuit can be accumulated in the trough part 240 and discharged from the evaporator 201, thereby improving heat transfer efficiency in the evaporator 201.

Figure 20:
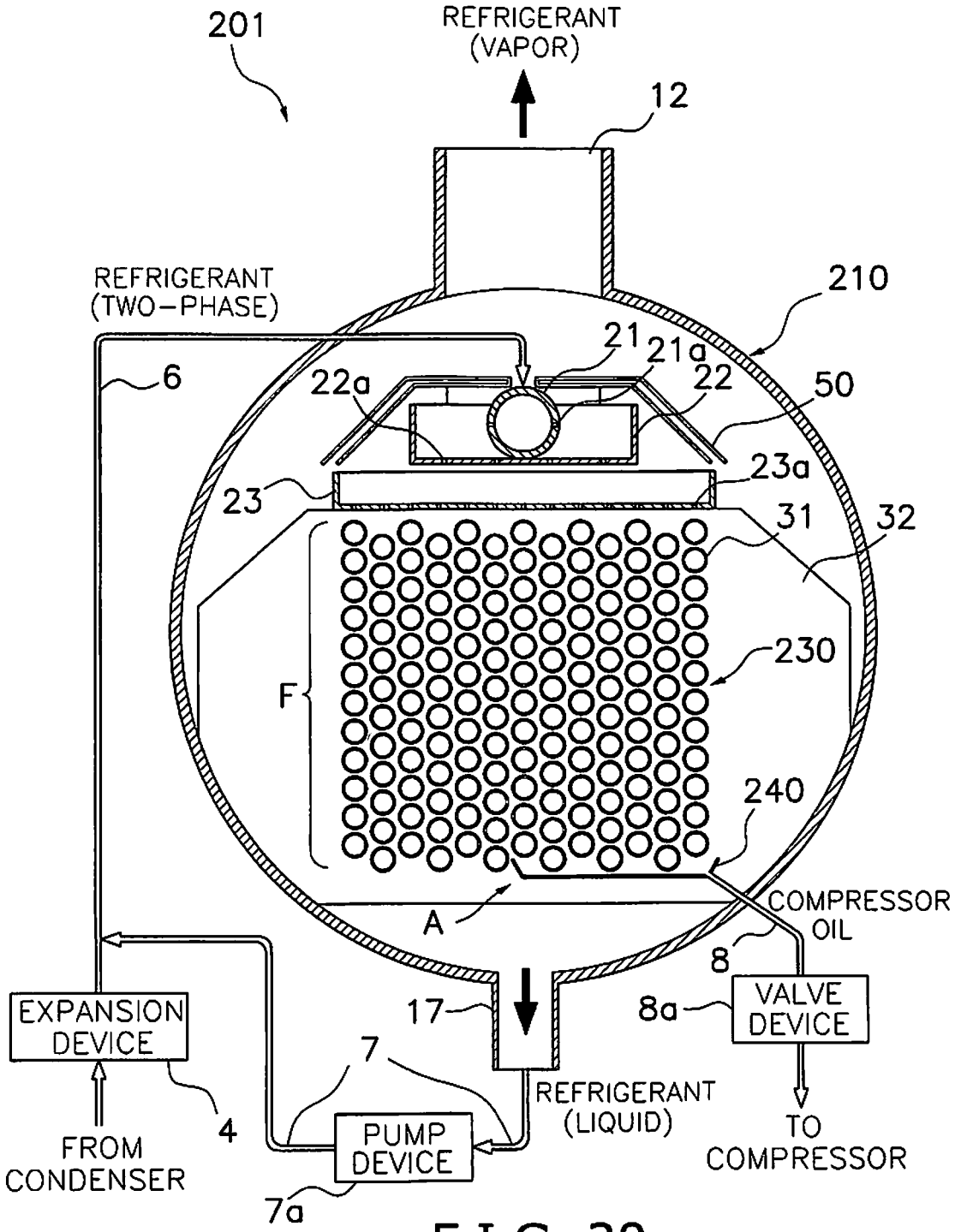
FIG. 20 is a simplified transverse cross sectional view of a heat exchanger according to a third embodiment of the present invention.

In the third embodiment, the arrangements for the tube bundle 230 and the trough part 240 are not limited to the ones illustrated in FIG. 20. It will be apparent to those skilled in the art from this disclosure that various changes and modifications can be made herein without departing from the scope of the invention. Several modified examples will be explained with reference to FIGS. 21 to 23.

Figure 21:
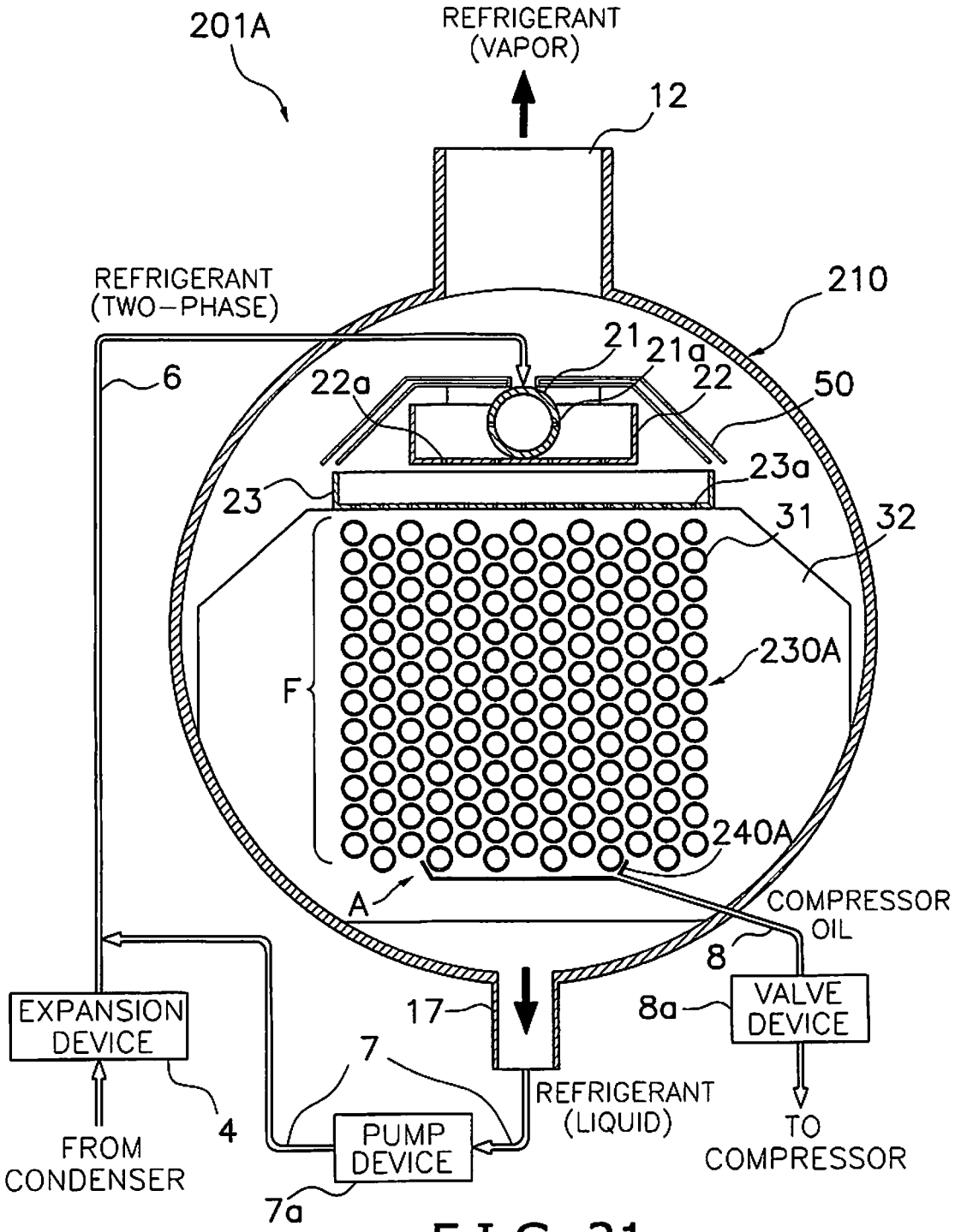
FIG. 21 is a simplified transverse cross sectional view of a heat exchanger illustrating a first modified example for an arrangement of a tube bundle and a trough part according to the third embodiment of the present invention.

FIG. 21 is a simplified transverse cross sectional view of an evaporator 201A illustrating a first modified example for an arrangement of a tube bundle 230A and a trough part 240A according to the third embodiment. As shown in FIG. 21, the trough part 240A may be placed at a center region below the lowermost row of the heat transfer tubes 31, instead of the side region as shown in FIG. 20.

Figure 22:
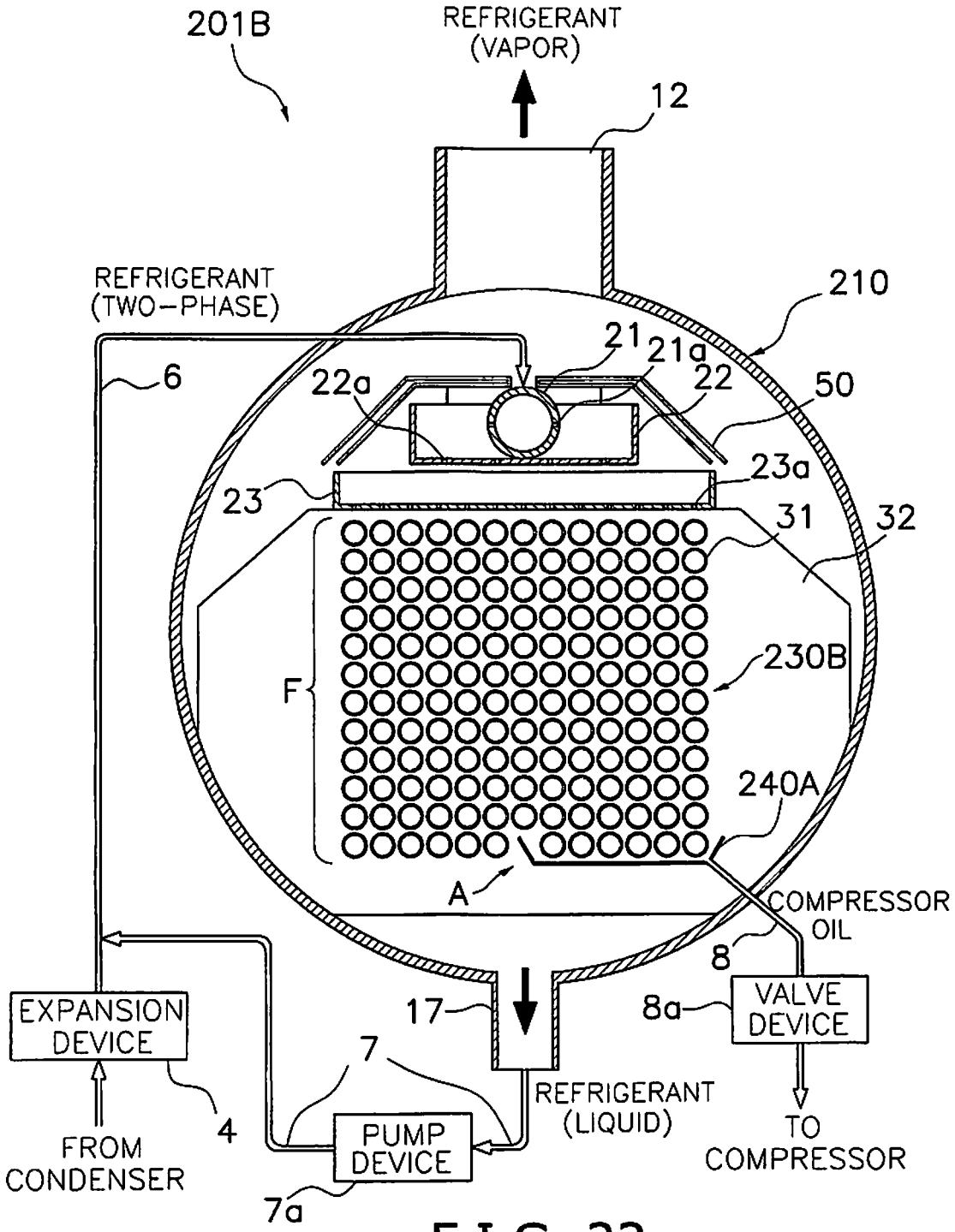
FIG. 22 is a simplified transverse cross sectional view of a heat exchanger illustrating a second modified example for an arrangement of a tube bundle and a trough part according to the third embodiment of the present invention.

FIG. 22 is a simplified transverse cross sectional view of an evaporator 201B illustrating a second modified example for an arrangement of a tube bundle 230B and a trough part 240B according to the third embodiment. The heat transfer tubes 31 of the tube bundle 230B are arranged not in a staggered pattern, but in a matrix as shown in FIG. 22.

Figure 23:
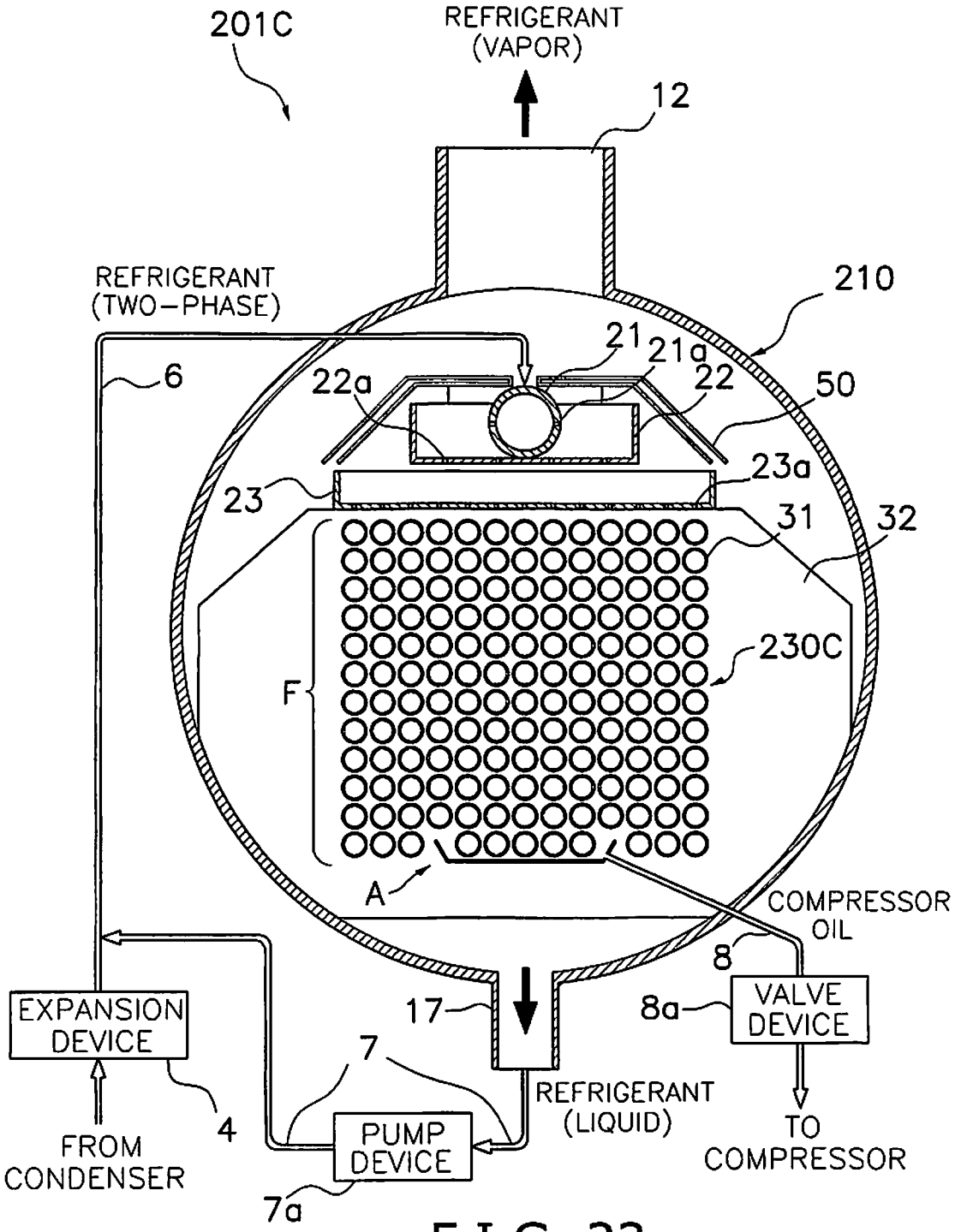
FIG. 23 is a simplified transverse cross sectional view of a heat exchanger illustrating a third modified example for an arrangement of a tube bundle and a trough part according to the third embodiment of the present invention.

FIG. 23 is a simplified transverse cross sectional view of an evaporator 201C illustrating a third modified example for an arrangement of a tube bundle 230C and a trough part 240C according to the third embodiment. In this example, the heat transfer tubes 31 of the tube bundle 230C are arranged in a matrix. The trough part 240C is disposed in the center region below the lowermost row of the heat transfer tubes 31.

Moreover, the heat transfer tubes 31 of the tube bundle 230 according to the third embodiment may be arranged in a similar manner as the heat transfer tubes 31 of the tube bundle 30F as shown in FIG. 18. In other words, the heat transfer tubes 31 of the tube bundle 230 of the third embodiment may be arranged so that a vertical pitch between the heat transfer tubes 31 is larger in an upper region of the tube bundle 230 than in a lower region of the tube bundle 230, and a horizontal pitch between the heat transfer tubes 31 is larger in an outer region of the tube bundle 230 than in a center region of the tube bundle 230.

Fourth Embodiment

Figure 24:
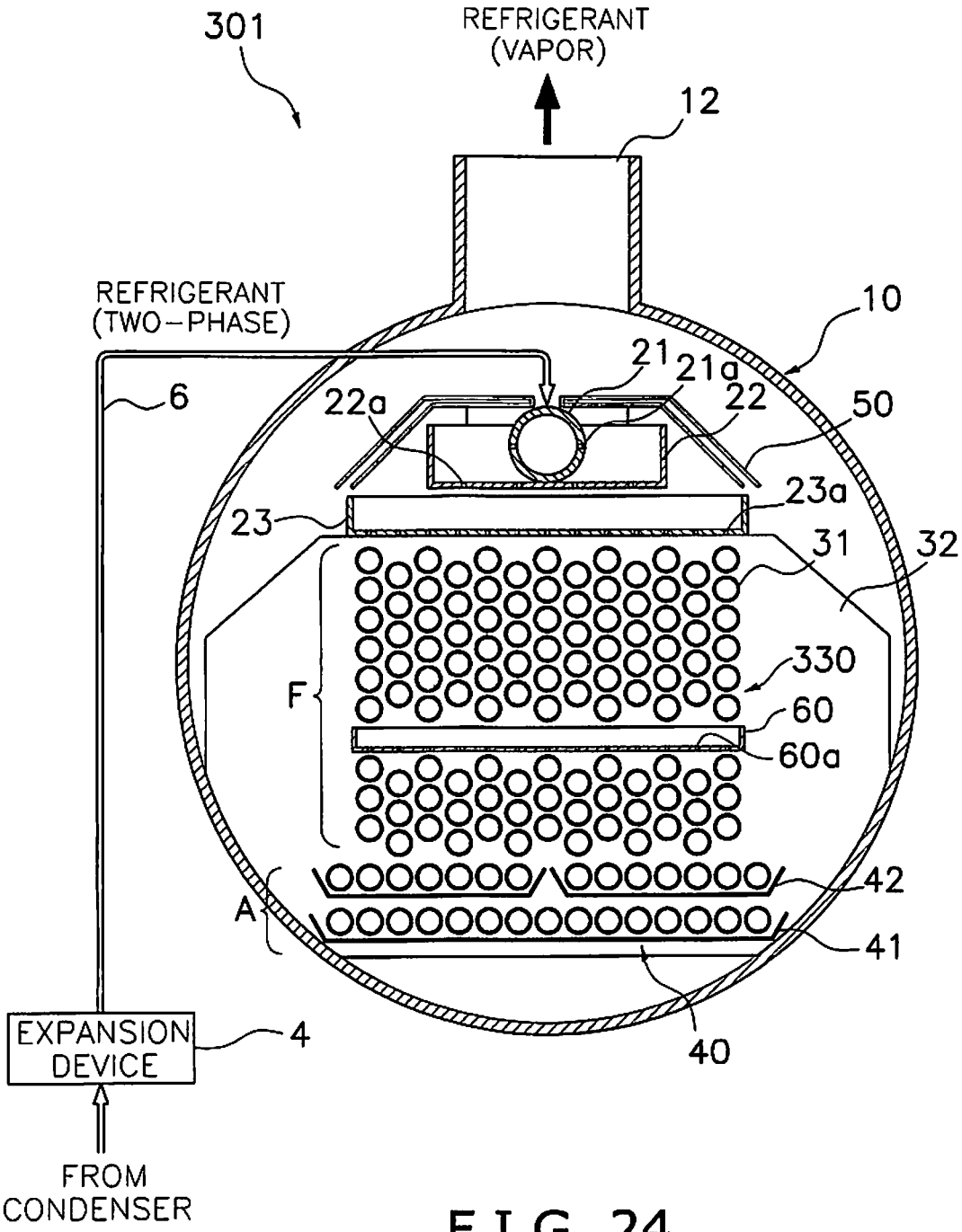
FIG. 24 is a simplified transverse cross sectional view of a heat exchanger according to a fourth embodiment of the present invention.
Figure 25:
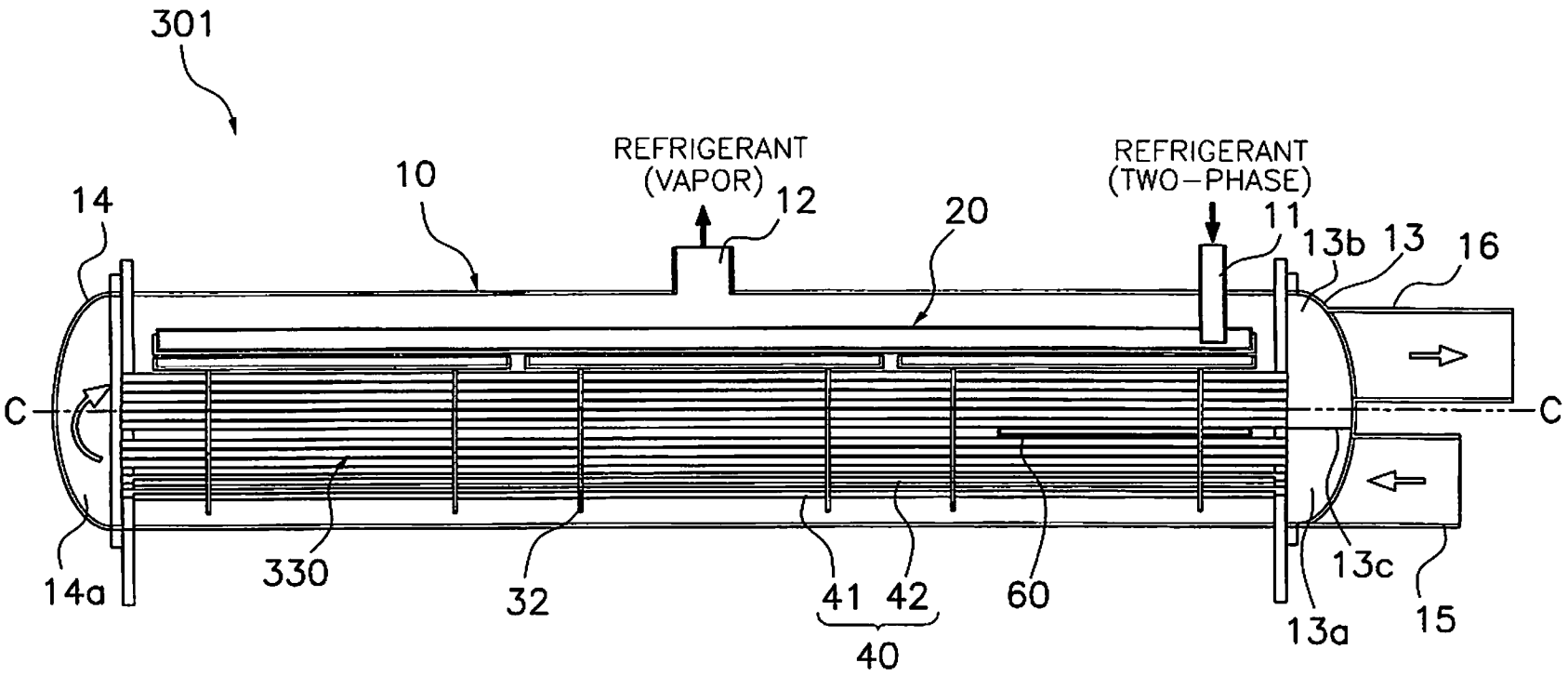
FIG. 25 is a simplified longitudinal cross sectional view of the heat exchanger according to the fourth embodiment of the present invention.

Referring now to FIGS. 24 and 25, an evaporator 301 in accordance with a fourth embodiment will now be explained. In view of the similarity between the first through fourth embodiments, the parts of the fourth embodiment that are identical to the parts of the first, second or third embodiment will be given the same reference numerals as the parts of the first, second or third embodiment. Moreover, the descriptions of the parts of the fourth embodiment that are identical to the parts of the first, second or third embodiment may be omitted for the sake of brevity.

The evaporator 301 of the fourth embodiment is basically the same as the evaporator 1 of the first embodiment except that an intermediate tray part 60 is provided in the falling film region F between the heat transfer tubes 31 in the supply line group and the heat transfer tubes 31 in the return line group. The intermediate tray part 60 includes a plurality of discharge openings 60*a* through which the liquid refrigerant is discharged downwardly.

As discussed above, the evaporator 301 incorporates a two pass system in which the water first flows inside the heat transfer tubes 31 in the supply line group, which is disposed in a lower region of the tube bundle 30, and then is directed to flow inside the heat transfer tubes 31 in the return line group, which is disposed in an upper region of the tube bundle 30. Therefore, the water flowing inside the heat transfer tubes 31 in the supply line group near the inlet water chamber 13*a* has the highest temperature, and thus, a greater amount of heat transfer is required. For example, as shown in FIG. 25, the temperature of the water flowing inside the heat transfer tubes 31 near the inlet water chamber 13*a* is the highest. Therefore, a greater amount of heat transfer is required in the heat transfer tubes 31 near the inlet water chamber 13*a*. Once this region of the heat transfer tubes 31 dries up due to uneven distribution of the refrigerant from the distributing part 20, the evaporator 301 is forced to perform heat exchange by using limited surface areas of the heat transfer tubes 31 that are not dried up, and the evaporator 301 is held in equilibrium with the pressure at the time. In such a case, in order to rewet the dried up portions of the heat transfer tubes 31, more than the rated amount (e.g., twice as much) of the refrigerant charge will be required.

Therefore, in the fourth embodiment, the intermediate tray part 60 is disposed at a location above the heat transfer tubes 31 which requires a greater amount of heat transfer. The liquid refrigerant falling from above is once received by the intermediate tray part 60, and redistributed evenly toward the heat transfer tubes 31, which requires a greater amount of heat transfer. Accordingly, these portions of the heat transfer tubes 31 are readily prevented from drying up, ensuring good heat transfer performance.

Although in the fourth embodiment the intermediate tray part 60 is provided only partially with respect to the longitudinal direction of the tube bundle 330 as shown in FIG. 25, the intermediate tray part 60 or a plurality of intermediate tray parts 60 may be provided to extend substantially the entire longitudinal length of the tube bundle 330.

Similarly to the first embodiment, the arrangements for the tube bundle 330 and the trough part 40 in the fourth embodiment are not limited to the ones illustrated in FIG. 24. It will be apparent to those skilled in the art from this disclosure that various changes and modifications can be made herein without departing from the scope of the invention. For example, the intermediate tray part 60 can be combined in any of the arrangements shown in FIGS. 12-15 and 17-23.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the above embodiments, the following directional terms "upper", "lower", "above", "downward", "vertical", "horizontal", "below" and "transverse" as well as any other similar directional terms refer to those directions of an evaporator when a longitudinal center axis thereof is oriented substantially horizontally as shown in FIGS. 6 and 7. Accordingly, these terms, as utilized to describe the present invention should be interpreted relative to an evaporator as used in the normal operating position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A heat exchanger adapted to be used in a vapor compression system, comprising:

a shell with a longitudinal center axis extending generally parallel to a horizontal plane;

a distributing part disposed inside of the shell, and configured and arranged to distribute a refrigerant, the distributing part including an inlet pipe part extending generally parallel to the longitudinal center axis of the shell, the inlet pipe part including a plurality of openings for discharging the refrigerant, and a first tray part at least partially disposed below the inlet pipe part and extending generally parallel to the longitudinal center axis of the shell, the first tray part having a bottom surface and side surfaces surrounding the bottom surface with a top of the first tray part being open and in direct communication with a space inside of the shell, the first tray part having a plurality of first discharge apertures disposed in the bottom surface of the first tray part, with no vertical gap being formed between a lowermost portion of the inlet pipe part and the bottom surface of the first tray part;

a baffle member disposed above the distributing part, the baffle member being configured and arranged to capture liquid droplets of the refrigerant entrained in vapor and to guide the liquid droplets toward the first tray part, the baffle member being spaced apart from the shell;

a tube bundle including a plurality of heat transfer tubes disposed inside of the shell below the distributing part so that the refrigerant discharged from the distributing part is supplied onto the tube bundle, the heat transfer tubes extending generally parallel to the longitudinal center axis of the shell, the tube bundle including a falling film region and an accumulating region arranged below the falling film region, the heat transfer tubes in the falling film region being arranged in a plurality of columns extending parallel to each other when viewed along the longitudinal center axis of the shell, the heat transfer tubes in the accumulating region being arranged in a plurality of rows extending parallel to each other when viewed along the longitudinal center axis of the shell; and a trough part including a plurality of trough sections extending generally parallel to the longitudinal center axis of the shell and disposed respectively below the rows of the heat transfer tubes in the accumulating region to accumulate the refrigerant therein, the trough part at least partially overlapping with at least one of the heat transfer tubes when viewed along a horizontal direction perpendicular to the longitudinal center axis of the shell.

2. The heat exchanger according to claim 1, wherein at least one of the trough sections continuously extends under all of the heat transfer tubes in at least one of the rows in the accumulating region.

3. The heat exchanger according to claim 1, wherein an outermost one of the heat transfer tubes in the accumulating region is positioned outwardly of an outermost one of the columns of the heat transfer tubes in the falling film region with respect to a transverse direction when viewed along the longitudinal center axis of the shell.

4. The heat exchanger according to claim 1, further comprising a supply conduit fluidly connected to the distributing part to supply the refrigerant to the distributing part, and a recirculation conduit fluidly connected to an opening formed on a bottom surface of the shell to recirculate the refrigerant accumulated in a bottom portion of the shell into the supply conduit.

5. The heat exchanger according to claim 1, wherein the trough part is spaced apart from a bottom portion of the shell.

6. The heat exchanger according to claim 1, wherein the trough part is provided only for the heat transfer tubes in the accumulating region and not for the heat transfer tubes in the falling film region.

7. The heat exchanger according to claim 1, wherein a bottom wall of the trough part is free of openings.

8. The heat exchanger according to claim 1, wherein the distributing part further includes a plurality of second tray parts disposed below the first tray part to receive the refrigerant discharged from the first discharge apertures such that the refrigerant accumulated in the second tray parts does not communicate between the second tray parts, the second tray parts being aligned along a direction generally parallel to the longitudinal center axis of the shell, each of the second tray parts having a plurality of second discharge apertures.

9. The heat exchanger according to claim 8, wherein a longitudinal length of the first tray part is substantially the same as an overall longitudinal length of the second tray parts.

10. The heat exchanger according to claim 8, wherein a longitudinal length of each of the second tray parts is substantially the same.

11. The heat exchanger according to claim 8, wherein a transverse width of each of the second tray parts is larger than a transverse width of the first tray part.

12. The heat exchanger according to claim 1, wherein the inlet pipe part has a circular cross-sectional shape.

* * * * *